US012723800B2

(12) United States Patent
Chung et al.

(10) Patent No.: US 12,723,800 B2
(45) Date of Patent: Sep. 1, 2026

(54) STOREHOUSE HAVING A HEATER FOR A HEAT EXCHANGER

(71) Applicant: LG ELECTRONICS INC., Seoul (KR)

(72) Inventors: Myungjin Chung, Seoul (KR); Yoonseong Nam, Seoul (KR); Jeongwon Park, Seoul (KR); Sounguk Kim, Seoul (KR); Kyungseok Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 33 days.

(21) Appl. No.: 18/577,506

(22) PCT Filed: Jul. 6, 2022

(86) PCT No.: PCT/KR2022/009804
§ 371 (c)(1),
(2) Date: Jan. 8, 2024

(87) PCT Pub. No.: WO2023/282645
PCT Pub. Date: Jan. 12, 2023

(65) Prior Publication Data

US 2024/0361065 A1 Oct. 31, 2024

(30) Foreign Application Priority Data

Jul. 8, 2021 (KR) ..... 10-2021-0089700

(51) Int. Cl.
*F25D 21/08* (2006.01)
*F25D 17/06* (2006.01)
(Continued)

(52) U.S. Cl.
CPC ..... *F25D 21/08* (2013.01); *F25D 17/062* (2013.01); *F25D 21/008* (2013.01); *F25D 21/14* (2013.01);
(Continued)

(58) Field of Classification Search
CPC ..... F25D 17/06; F25D 17/062; F25D 17/067; F25D 17/08; F25D 21/00; F25D 21/08; F25D 21/14; F25D 2321/1441
See application file for complete search history.

(56) References Cited

U.S. PATENT DOCUMENTS 5,709,096 A * 1/1998 Tamai ..... F25B 47/022 62/155
6,629,429 B1 10/2003 Kawamura et al.
(Continued)

FOREIGN PATENT DOCUMENTS

JP 2006-200765 8/2006
JP 2013-104650 5/2013
(Continued)

OTHER PUBLICATIONS

Extended European Search Report dated Mar. 28, 2025, issued in Application No. 22837997.0.
(Continued)

*Primary Examiner* — Jonathan Bradford
(74) *Attorney, Agent, or Firm* — KED & ASSOCIATES, LLP

(57) ABSTRACT

A storehouse may include a first storage space configured to provide a space in which goods are stored within a predetermined temperature or a predetermined temperature range and a second storage space configured to provide a space in which a first heat exchanger is accommodated. The storehouse may include a third storage space configured to provide a space in which a second heat exchanger is accom-
(Continued)

modated. The storehouse may include a fluid generator disposed downstream of the first heat exchanger to generate a flow. The storehouse may include a heater disposed adjacent to the first heat exchanger or the fluid generator and configured to defrost at least one of the first heat exchanger and the fluid generator.

15 Claims, 15 Drawing Sheets

(51) Int. Cl.
*F25D 21/00* (2006.01)
*F25D 21/14* (2006.01)

(52) U.S. Cl.
CPC .. *F25D 2321/1441* (2013.01); *F25D 2600/02* (2013.01)

(56) References Cited

U.S. PATENT DOCUMENTS

| | | | | |
|---|---|---|---|---|
| 2018/0187944 | A1 | 7/2018 | Park et al. | |
| 2018/0283766 | A1* | 10/2018 | Jung | F28F 1/40 |
| 2021/0131717 | A1 | 5/2021 | Ko et al. | |

FOREIGN PATENT DOCUMENTS

| | | |
|---|---|---|
| KR | 10-2018-0129178 | 12/2018 |
| WO | WO 2021/086124 | 5/2021 |

OTHER PUBLICATIONS

International Search Report dated Nov. 2, 2022 issued in Application No. PCT/KR2022/009804.

* cited by examiner

STOREHOUSE HAVING A HEATER FOR A HEAT EXCHANGER

CROSS-REFERENCE TO RELATED PATENT APPLICATIONS

This application is a U.S. National Stage Application under 35 U.S.C. § 371 of PCT Application No. PCT/KR2022/009804, filed Jul. 6, 2022, which claims priority to Korean Patent Application No. 10-2021-0089700, filed Jul. 8, 2021, whose entire disclosures are hereby incorporated by reference.

TECHNICAL FIELD

The present disclosure relates to a storehouse.

BACKGROUND ART

A storehouse may include a storage space for storing goods. Examples of the storehouse may include a refrigerator.

The refrigerator is an apparatus that cools objects to be cooled (e.g., food, drugs, and cosmetics) (hereinafter referred to as food for convenience), or stores food at low temperature so as to prevent spoilage and deterioration. The refrigerator includes a storage space in which food is stored, and a refrigeration cycle part that cools the storage space.

The refrigeration cycle part may include a compressor, a condenser, an expansion mechanism, and an evaporator, through which a refrigerant circulates.

A refrigerator according to the related art may include an outer case, and an inner case located inside the outer case and having an opened front side. Such a refrigerator may include a cold air discharge duct disposed inside the inner case to partition the inside of the inner case into a storage space and a heat exchange space. For example, the storage space may be defined in front of the cold air discharge duct, and the heat exchange space may be defined in the rear of the cold air discharge duct. An evaporator and an evaporating fan may be disposed in the heat exchange space.

The refrigerator may have a separate machine space defined outside the inner case. A compressor, a condenser, and a condensing fan may be disposed in the machine space. The compressor in the machine space may be connected to the evaporator in the heat exchange space through a refrigerant pipe.

The storage space may be provided with a withdrawable drawer. A plurality of the drawers may be provided in a vertical direction.

However, the refrigerator according to the related art as described above has the following problems.

First, the compressor in the machine space and the evaporator in the inner case are disposed in spaces separated from each other and are connected to each other by the refrigerant pipe. Therefore, when it is necessary to repair the refrigeration cycle part, it is inconvenient to take out food stored in the refrigerator so as to check and repair failure.

Second, since the evaporator has to be integrally formed inside the refrigerator body and the evaporator has to be fixed to the refrigerator body by welding or the like, there is an inconvenience in manufacturing the refrigerator. In addition, when the evaporator defrosts, heat exchange with the storage space increases the internal temperature of the refrigerator.

Third, since the heat exchange space is disposed in the rear of the storage space, the width of the rear wall of the refrigerator body in the front-and-rear direction increases as much as the size of the heat exchange space. Therefore, the volume of the storage space is reduced as much.

In order to solve these problems, a refrigerator including a cooling module that integrally configures a heat absorbing portion and a heat dissipating portion has been proposed.

Disclosure

Technical Problem

An embodiment of the present disclosure aims to provide a storehouse in which a first storage space configured to provide a space in which goods are stored is fluidly connected to a second storage space configured to provide a space in which a first heat exchanger is accommodated.

An embodiment of the present disclosure aims to provide a storehouse including a heat exchanger case forming a second wall and in which a first heat exchanger is installed.

An embodiment of the present disclosure aims to provide a storehouse including a first heat exchanger heat configured to provide heat for defrosting in a conduction manner.

An embodiment of the present disclosure aims to provide a refrigerator in which a fan assembly is installed so as to defrost a first fan.

An embodiment of the present disclosure aims to provide a refrigerator in which a heater is installed in a heat exchanger case so as to melt ice generated inside the heat exchanger case.

An embodiment of the present disclosure aims to provide a refrigerator capable of sufficiently improving defrosting performance of a fan only by driving a fan heater with a small capacity because a first heat exchanger heater is driven to increase an internal temperature of a heat exchanger case and then the fan heater is driven to defrost the fan.

Technical Solution

The present disclosure may be a storehouse including a first storage space configured to provide a space in which goods are stored within a predetermined temperature or a predetermined temperature range and a second storage space configured to provide a space in which a first heat exchanger is accommodated.

The storehouse may include a third storage space configured to provide a space in which a second heat exchanger is accommodated.

The storehouse may include a first wall defining at least a part of the first storage space.

The storehouse may include a second wall defining at least a part of the second storage space.

The storehouse may include a third wall defining at least a part of the third storage space.

The storehouse may include a heat exchanger case accommodating the first heat exchanger and constituting at least a part of the second wall of the second storage space.

A fan assembly may be disposed downstream of the first heat exchanger.

The fan assembly may include a first fan configured to generate a flow.

The fan assembly may include a shroud accommodating the first fan.

The fan assembly may include a fan heater disposed adjacent to the first fan.

The fan heater may be installed in the shroud.

The fan heater may be disposed along the outer periphery of first fan.

The fan heater may have a round shape.

The shroud may include a heater seat on which the fan heater is installed.

The heater seat may extend roundly along the outer periphery of the first fan.

The shroud may include first and second parts defining an installation space of the first fan.

The first part may form a fan suction portion through which the fluid is sucked into the fan assembly.

The fan heater may be provided on the outer periphery of the fan suction portion.

The heat exchanger case may include a case heater configured to melt ice formed in the heat exchanger case.

The case heater may be provided on the bottom surface of the heat exchanger case.

The case heater may include a planar heater.

When the accumulated time during the normal operation of the storehouse exceeds a predetermined time, the first heat exchanger heater may be driven and the fan heater may be driven after the driving of the first heat exchanger heater is completed.

When the predetermined time elapses after the start of the driving of the first heat exchanger heater, the driving of the fan heater may start.

The driving of the first heat exchanger heater may be completed before the driving of the fan heater.

The driving of the first heat exchanger heater may be stopped when the temperature of the shroud is higher than a first predetermined temperature.

The driving of the fan heater may be stopped when the temperature of the shroud is higher than a second predetermined temperature.

In one aspect of the present disclosure, a storehouse may include a first storage space configured to provide a space in which goods are stored within a predetermined temperature or a predetermined temperature range and a second storage space configured to provide a space in which a first heat exchanger is accommodated.

The storehouse may include a third storage space configured to provide a space in which a second heat exchanger is accommodated.

The storehouse may include a first wall defining at least a part of the first storage space, a second wall defining at least a part of the second storage space, and a third wall defining at least a part of the third storage space.

The storehouse may include a fluid generator disposed downstream of the first heat exchanger and configured to generate a flow, and a heater disposed adjacent to the first heat exchanger or the fluid generator and configured to defrost at least one of the first heat exchanger and the fluid generator.

The second storage space may be fluidly connected to the first storage space.

The heater may include a fan heater provided in the fluid generator.

The fluid generator may include a first fan, and a shroud configured to accommodate the first fan and having a heater seat on which the fan heater is installed.

The fan heater may be disposed along the outer periphery of the first fan.

The shroud may include a first part having a fan seat on which the first fan is placed, and a second part defining an accommodation space of the first fan together with the first part and forming a fan suction portion into which the fluid passing through the first heat exchanger is introduced.

The storehouse may further include a heat exchanger case forming the second storage space and in which the first heat exchanger is installed, and at least a portion of the first fan may be located inside the heat exchanger case.

The first heat exchanger and the first fan may be arranged in a first direction, and the heater seat may define a width of the shroud in the first direction so as to surround a portion of the outer periphery of the first fan.

The fan heater may include first and second fan heaters arranged in a line to the heater seat of the shroud.

The second storage space may form a discharge passage through which the fluid is discharged, and the fan assembly may be disposed adjacent to the discharge passage.

The discharge passage may be located closer to a center of the fluid generator than a center of the first heat exchanger.

The heater may include a first heat exchanger heater provided in the first heat exchanger, the first heat exchanger being coupled to a fin of the first heat exchanger so that heat is transferred by a conduction method.

The storehouse may further include a partition wall configured to partition the second storage space and the first storage space, and the first heat exchanger heater may include a first heater provided at one end of the first heat exchanger located adjacent to the partition wall, and a second heater provided at the other end of the first heat exchanger forming an end opposite to the one end of the first heat exchanger.

The storehouse may further include a controller configured to control the first heat exchanger heater and the fan heater so that the fan heater is driven after the driving of the first heat exchanger heater is completed.

The storehouse may further include a heat exchanger case forming the second storage space, and the heater may include a case heater disposed adjacent to the outside of the first heat exchanger.

The heat exchanger case may include an inner surface on which the first heat exchanger is placed, and the case heater may include a planar heater installed on an inner surface of the heat exchanger case.

Advantageous Effects

According to an embodiment of the present disclosure, first and second storage spaces are fluidly connected to each other. Therefore, the fluid heat-exchanged in a first heat exchanger may be easily supplied to the first storage space, and the fluid in the first storage space may be easily returned to the second storage space.

According to an embodiment of the present disclosure, a defrost heater that provides heat for defrosting in a conduction manner is provided in a first heat exchanger, thereby improving the defrosting efficiency of the first heat exchanger.

According to an embodiment of the present disclosure, a heater is installed in a fan assembly to easily defrost a first fan.

According to an embodiment of the present disclosure, a heater is installed in a heat exchanger case so as to melt ice generated inside the heat exchanger case.

According to an embodiment of the present disclosure, since a first heat exchanger heater is driven to increase an internal temperature of a heat exchanger case and then a fan heater is driven to defrost a fan, it is possible to sufficiently improve defrosting performance of the fan only by driving the fan heater with a small capacity.

MODE FOR INVENTION

Figure 1:
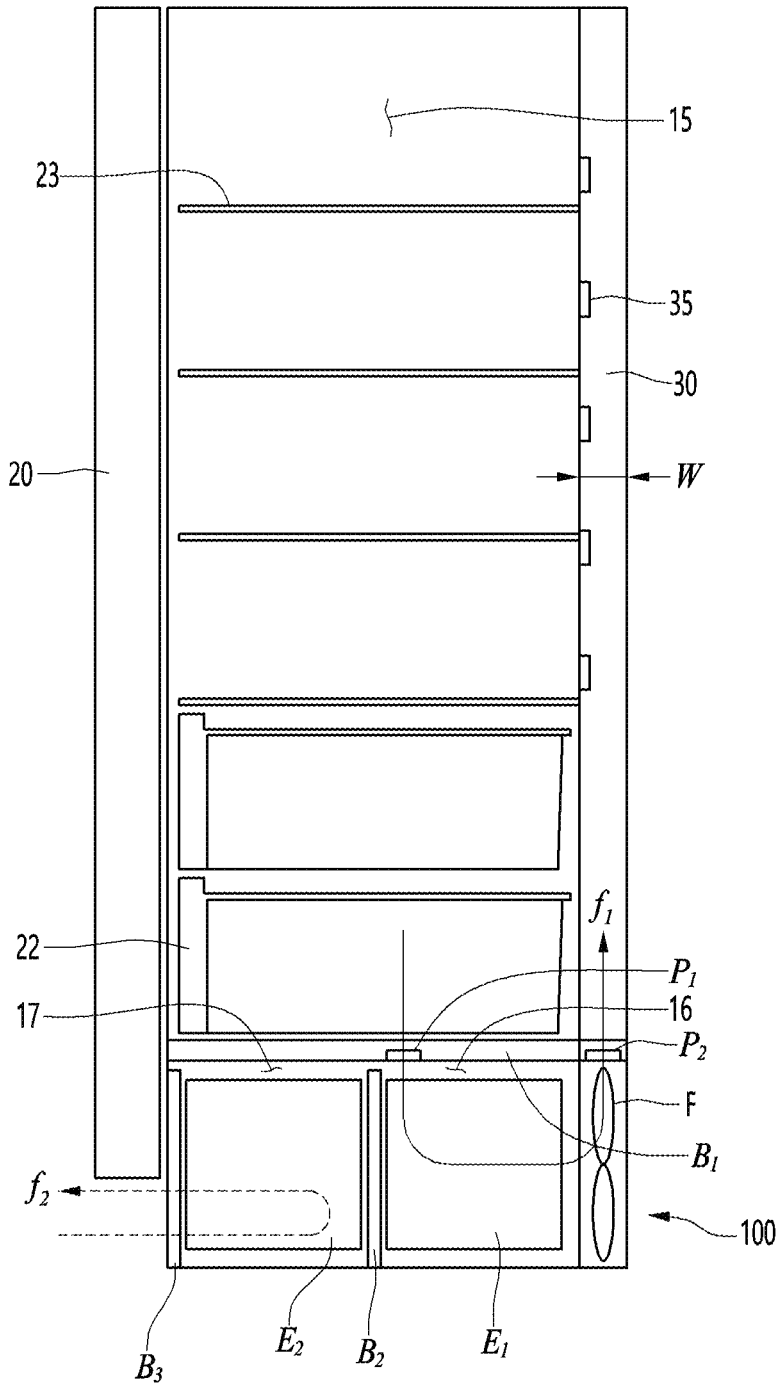
FIG. 1 is a schematic diagram of a storehouse according to an embodiment of the present disclosure.

The present disclosure may be a storehouse including a first storage space configured to provide a space in which goods are stored within a predetermined temperature or a predetermined temperature range and a second storage space configured to provide a space in which a first heat exchanger is accommodated.

Examples of the storehouse may be a refrigerator, a heating cabinet, and the like.

Examples of the goods may include food, medical products, and the like.

The storehouse may include a third storage space configured to provide a space in which a second heat exchanger is accommodated.

The storehouse may include a first wall defining at least a part of the first storage space.

The storehouse may include a second wall defining at least a part of the second storage space.

The storehouse may include a third wall defining at least a part of the third storage space.

The second storage space may be fluidly connected to the first storage space.

The first heat exchanger may be a heat exchanger that is fluidly connected to an inner space of the first storage space to exchange heat with a fluid present in the inner space.

The second heat exchanger may be a heat exchanger that is fluidly connected to an outer space of the first storage space to exchange heat with a fluid present in the outer space.

Examples of a heat exchange method of the heat exchanger may include direct heat exchange by conduction or indirect heat exchange by convection or radiation.

An example of the heat exchanger may be a heat absorbing portion, a cooling power generator, and a heat exchanger provided as a cold source. An example of the cold source may be an evaporator, a heat absorbing surface of a thermoelectric element as a heat absorbing portion of a thermoelectric module, or a cold sink connected to the heat absorbing surface.

Another example of the heat exchanger may be a heat dissipating portion, a heat power generator, and a heat exchanger provided as a heat source. Examples of the heat source may be a condenser, a heat generating surface of a thermoelectric element as a heat dissipating portion of a thermoelectric module, or a heat sink connected to the heat generating surface. Examples of the fluid may include a liquid or a gas, such as air, water, and a refrigerant.

The first wall may be provided to separate the inner space of the first storage space from the outer space of the first storage space.

The second wall may be provided to separate the inner space of the second storage space from the outer space of the second storage space.

The third wall may be provided to separate the inner space of the third storage space from the outer space of the third storage space.

The first wall may be provided to separate the first storage space from at least one of the second storage space and the third storage space.

The second wall may be provided to separate the second storage space from at least one of the first storage space and the third storage space.

The third wall may be provided to separate the third storage space from at least one of the first storage space and the second storage space.

The wall provided to separate the first storage space from the second storage space may be provided as a common wall between the first wall and the second wall.

The wall provided to separate the second storage space from the third storage space may be provided as a common wall between the second wall and the third wall.

The wall provided to separate the first storage space from the third storage space may be provided as a common wall between the first wall and the third wall.

The wall may be provided as one wall including a plurality of layers. A plurality of walls may be connected in a longitudinal direction and provided as one wall.

Fluidly connecting the first space and the second space may be defined as follows: the fluid in one of the first space and the second space is movable to the other one of the first space and the second space.

The storehouse may include a door provided to open or close the first storage space. The door may be provided to cover at least a part of the second storage space. The door may be provided to cover at least a part of the third storage space.

In the present disclosure, when an object is divided into three equal portions based on the longitudinal direction of the object, the central portion of the object may be defined as the position located in the center among the three equally-divided portions. The peripheral portion of the object may be defined as a portion located to the left or right of the central portion among the three equally-divided portions. The peripheral portion of the object may include a surface in contact with the central portion and a surface opposite thereto. The opposite surface may be defined as a border or an edge of the object.

The storehouse may include a fluid generator disposed on a path through which the fluid flows so that the fluid in the inner space of the storage space flows to the outer space of the storage space.

The fluid generator may include a fluid generator for the second storage space disposed on a path through which the fluid flows so that the fluid in the second storage space flows to the outer space of the second storage space.

The fluid generator may include a fluid generator for the third storage space disposed on a path through which the fluid flows so that the fluid in the third storage space flows to the outer space of the third storage space.

Examples of the fluid generator may include a fan allowing air to flow, a pump allowing water to flow, a compressor allowing a refrigerant to flow, and the like.

A first passage, through which the fluid flows, may be provided inside of the first wall or in the vicinity of the first wall.

Examples of the first passage may be a through hole defined to pass through the inside of the wall, a duct provided inside the wall, or a duct provided outside the wall.

The first passage may include an inlet passage configured to guide the fluid in the outer space of the first storage space to flow to the inner space of the first storage space.

The first passage may include an outlet passage configured to guide the fluid in the inner space of the first storage space to flow to the outer space of the first storage space.

The first passage may include an inlet passage configured to guide the fluid heat-exchanged in the outer space of the first storage space to flow to the inside of the first storage space.

The first passage may include an outlet passage configured to guide the fluid heat-exchanged with goods in the inner space of the first storage space to flow to the outer space of the first storage space.

The inlet passage may be provided in at least one of a front wall, a rear wall, a side wall, an upper wall, and a lower wall of the first storage space.

The outlet passage may be provided in at least one of the front wall, the rear wall, the side wall, the upper wall, and the lower wall of the first storage space.

For example, the inlet passage may be provided as a through hole or a duct disposed in the rear wall of the first storage space.

For example, the outlet passage may be provided as a through hole or a duct disposed in the lower wall of the first storage space.

A second passage, through which the fluid flows, may be provided inside of the second wall or in the vicinity of the second wall.

Examples of the second passage may be a through hole defined to pass through the inside of the wall, a duct provided inside the wall, or a duct provided outside the wall.

The second passage may include an inlet passage configured to guide the fluid in the outer space of the second storage space to flow to the inner space of the second storage space.

The second passage may include an outlet passage configured to guide the fluid in the inner space of the second storage space to flow to the outer space of the second storage space.

The second passage may include an inlet passage configured to guide the fluid heat-exchanged in the outer space of the second storage space to flow to the inside of the second storage space.

The second passage may include an outlet passage configured to guide the fluid heat-exchanged with the first heat exchanger to flow to the outer space of the second storage space.

The inlet passage may be provided in at least one of a front wall, a rear wall, a side wall, an upper wall, and a lower wall of the second storage space.

For example, the inlet passage may be provided as a through hole or a duct disposed in the upper wall of the second storage space.

For example, the outlet passage may be provided as a through hole or a duct disposed in the upper wall of the second storage space.

A third passage, through which the fluid flows, may be provided inside of the third wall or in the vicinity of the third wall.

Examples of the third passage may be a through hole defined to pass through the inside of the wall, a duct provided inside the wall, or a duct provided outside the wall.

The third passage may include an inlet passage configured to guide the fluid in the outer space of the third storage space to flow to the inner space of the third storage space.

The third passage may include an outlet passage configured to guide the fluid in the inner space of the third storage space to flow to the outer space of the third storage space.

The third passage may include an inlet passage configured to guide the fluid heat-exchanged in the outer space of the third storage space to flow to the inside of the third storage space.

The third passage may include an outlet passage configured to guide the fluid heat-exchanged with the second heat exchanger to flow to the outer space of the third storage space.

The inlet passage may be provided in at least one of a front wall, a rear wall, a side wall, an upper wall, and a lower wall of the third storage space.

The outlet passage may be provided in at least one of the front wall, the rear wall, the side wall, the upper wall, and the lower wall of the third storage space.

For example, the inlet passage may be provided as a through hole or a duct disposed in the front wall of the third storage space.

For example, the outlet passage may be provided as a through hole or a duct disposed in the front wall of the third storage space.

The fluid in the inner space of the first storage space may be fluidly connected to one of the second storage space and the third storage space.

For example, the fluid in the inner space of the first storage space may flow to the inner space of the second storage space via the second passage.

The fluid in the inner space of the second storage space may flow to the inner space of the first storage space via the first passage.

The fluid in the outer space of the storehouse may be fluidly connected to one of the second storage space and the third storage space.

For example, the fluid in the inner space of the third storage space may flow to the outer space of the third storage space via the third passage.

The fluid in the outer space of the third storage space may flow to the inner space of the third storage space via the third passage.

The second storage space may be disposed in the outer space of the first storage space together with the third storage space.

At least a part of the second wall may be coupled to at least a part of the third wall and then disposed in the outer space of the first storage space.

At least a part of the second wall may be integrally provided with at least a part of the third wall and then disposed in the outer space of the first storage space.

At least a part of the second wall may extend so as to be provided as at least a part of the third wall.

At least a part of the third wall may extend so as to be provided as at least a part of the second wall.

At least a part of the second wall may extend to support at least a part of the third wall.

At least a part of the third wall may extend to support at least a part of the second wall.

The portion from which the second wall extends may be provided on at least one of the front wall, the rear wall, the side wall, the upper wall, and the rear wall of the second storage space.

The portion from which the third wall extends may be provided on at least one of the front wall, the rear wall, the side wall, the upper wall, and the rear wall of the third storage space.

For example, the portion from which the second wall extends may be provided on the lower wall of the second storage space.

As another example, the portion from which the third wall extends may be provided on the lower wall of the third storage space.

The first heat exchanger acting as a cold source may be provided in the second storage space.

A heat source that removes frost generated in the first heat exchanger may be disposed in the vicinity of the first heat exchanger.

For example, the heat source may be a defrosting heat source.

The first heat exchanger acting as a heat source may be provided in the second storage space.

A cold source that removes steam generated in the first heat exchanger may be disposed in the vicinity of the first heat exchanger.

For example, the cold source may be a steam removing cold source.

The second wall may include a through hole through which the second storage space is fluidly connected to the first storage space.

The second wall may include a portion having a higher degree of insulation than the third wall.

The second wall may be a wall that partitions the first storage space and the second storage space.

In this manner, it is possible to reduce the transfer of the heat of the defrosting heat source or the cold of the steam removing cold source to the first storage space or the outer space of the second storage space.

The second wall may include a through hole through which the second storage space is fluidly connected to the first passage.

The second wall may include a portion having a higher degree of insulation than the wall defining the first passage. In this manner, it is possible to reduce the transfer of the heat of the defrosting heat source or the cold of the steam removing cold source to the first storage space or the outer space of the second storage space.

The first storage space may include a plurality of storage compartments. The first storage space may include at least one of a partition wall, a drawer, and a shelf so as to form the plurality of storage compartments. A passage through which a fluid flows may be provided between the plurality of storage compartments.

An embodiment capable of reducing heat exchange between the defrosting heat source or the steam removing cold source and some of the plurality of storage compartments is as follows. In this manner, when the storehouse is provided as a refrigerator, cooling efficiency may be improved, and when the storehouse is provided as a heating cabinet, heating efficiency may be improved.

First, one of the plurality of storage compartments may include a surface that faces the second storage space and a surface that faces another one of the plurality of storage compartments.

One of the plurality of storage compartments may be disposed between the second storage space and another one of the plurality of storage compartments. In this case, one of the plurality of storage compartments may be provided as an insulating space for reducing heat transfer between another one of the plurality of storage compartments and the defrosting heat source or the steam removing cold source.

Second, one of the plurality of storage compartments may include both the through hole through which the fluid flows into the second storage space and the through hole through which the fluid flows out from the second storage space, and another one of the plurality of storage compartments may include only one of the through hole through which the fluid flows into the second storage space and the through hole through which the fluid flows out from the second storage space.

For example, the through hole of one of the plurality of storage compartments may be provided inside of the second wall or in the vicinity of the second wall. The through hole of another one of the plurality of storage compartments may be provided inside of the first wall or in the vicinity of the first wall.

Third, only one of the plurality of storage compartments may be disposed to face the second storage space or may be disposed adjacent to the second storage space. For example, one of the plurality of storage compartments may be provided in at least one of the uppermost end, the lowermost end, the rightmost end, the leftmost end, the rearmost end, and the foremost end of the second storage space.

Fourth, the fluid inside the first storage compartment among the plurality of storage compartments may be provided to flow into the second storage space without passing through another one of the plurality of storage compartments, and the fluid inside the second storage compartment among the plurality of storage compartments may be provided to flow into the second storage space through another one of the plurality of storage compartments.

An embodiment in which the second storage space and the third storage space are disposed is as follows.

First, the first storage space may include a portion extending in a horizontal direction, i.e., X-axis direction, and a portion extending in a vertical direction, i.e., Y-axis direction. The second storage space may be disposed adjacent to the third storage space in the X-axis direction. A wall that partitions the second storage space and the third storage space may include a portion extending in the Y-axis direction.

Second, the first storage space may include a portion extending in a horizontal direction, i.e., X-axis direction, and a portion extending in a vertical direction, i.e., Y-axis direction. The second storage space may be disposed adjacent to the third storage space in the Y-axis direction. A wall that partitions the second storage space and the third storage space may include a portion extending in the X-axis direction.

An embodiment in which the first heat exchanger and the fluid generator are disposed is as follows.

First, the first heat exchanger may include a long portion extending in the X-axis direction and a short portion extending in the Y-axis direction, and the fluid generator may be disposed such that a length in the X-axis direction is longer than a length in the Y-axis direction.

The fluid generator may be disposed spaced apart from the first heat exchanger in the Y-axis direction.

For example, the fluid generator may be disposed above or below the first heat exchanger.

The fluid generator may be disposed to overlap the first heat exchanger in the Y-axis direction. The fluid generator may be disposed in an inclined direction with respect to the ground.

A suction hole through which the fluid is sucked into the first heat exchanger may be disposed to be lower than a discharge hole through which the fluid heat-exchanged with the first heat exchanger is discharged.

In this manner, the effect of reducing the flow loss of the fluid generator may be obtained.

Second, the first heat exchanger may include a long portion extending in the X-axis direction and a short portion extending in the Y-axis direction, and the fluid generator may be disposed such that a length in the X-axis direction is shorter than a length in the Y-axis direction.

The fluid generator may be disposed spaced apart from the first heat exchanger in the X-axis direction. For example, the fluid generator may be disposed in the front or rear of the first heat exchanger. The fluid generator may be disposed to overlap the first heat exchanger in the X-axis direction.

The storehouse may include a fluid generator for the second storage space. An embodiment of the arrangement of the fluid generator is as follows.

First, an imaginary line extending from the center of the fluid generator toward the first heat exchanger may be disposed to pass through the first heat exchanger. The center of the fluid generator may be defined as at least one of the center of gravity, the center of mass, the center of volume, and the center of rotation of the fluid generator. The imaginary line may be disposed to pass through the central portion of the first heat exchanger. The imaginary line may be disposed to pass through the periphery of the first heat exchanger.

Second, an imaginary line extending from the center of the fluid generator toward the first storage space may be disposed to pass through the first storage space. An imaginary line extending from the center of the fluid generator toward the first heat exchanger may be disposed so as not to overlap the first heat exchanger.

Third, the fluid generator may be disposed inside the second storage space. In this case, the first heat exchanger and the fluid generator may be disposed inside the second storage space, which may be advantageous in designing a module for the second storage space. At least a part of the second passage may be provided to be exposed to the second storage space.

Fourth, the fluid generator may be disposed in at least one of the inside of the first passage and the inside of the second passage. In this case, since the distance between the first heat exchanger and the fluid generator may be separated, there is an advantage that can reduce a dead zone that may occur in the flow passage of the fluid. The passage on which the fluid generator is disposed may include a portion protruding toward the first storage space. Therefore, the volume of the first storage space may be increased. The fluid generator may be disposed inside the protruding portion.

Fifth, at least a part of the fluid generator may be provided to form at least a part of the first passage or at least a part of the second passage. For example, the fluid generator may include a fan and a fan housing. The fan housing may define at least a part of the first passage, or the fan housing may define at least a part of the second passage.

Hereinafter, some embodiments of the present disclosure will be described in detail with reference to exemplary drawings. In assigning reference numerals to the components of the drawings, it should be noted that the same components are denoted by the same reference numerals as much as possible even though the components are shown in different drawings. In addition, in describing the embodiments of the present disclosure, if the detailed description of the relevant known functions or configurations is determined to unnecessarily obscure the gist of the present disclosure, the detailed description thereof is omitted.

In addition, the terms, such as "first", "second", "A", "B", "(a)", or "(b)" may be used herein to describe the components of the present disclosure. These terms are only for distinguishing one component from another, and the essence, order, or sequence of the components is not limited by the terms. When one component is described as being "connected", "coupled", or "linked" to another component, the component may be directly connected or coupled to the other component, but it should be understood that another component may be "connected", "coupled" or "linked" between components.

FIG. 1 is a schematic diagram of a storehouse according to an embodiment of the present disclosure.

Referring to FIG. 1, a storehouse 1 according to an embodiment of the present disclosure includes a storehouse body 10 defining a first storage space 15.

The storehouse may be configured as a refrigerator or a heating cabinet.

The first storage space 15 may provide a space in which goods are stored within a predetermined temperature or a predetermined temperature range.

The storehouse 1 may include a first wall defining at least a part of the first storage space 15.

The first wall may include at least one of a front wall, a rear wall, a side wall, an upper wall, and a lower wall.

The first wall may include a plurality of walls.

For example, the storehouse body 10 may have a hexahedral shape with an opened front side. However, the shape of the storehouse body 10 is not limited thereto.

The storehouse body 10 may include a body outer case 11 (referring to FIG. 3), a body inner case 12 (referring to FIG. 3) assembled inside the body outer case 11, and a body insulating material 13 (referring to FIG. 3) for insulation provided between the body outer case 11 and the body inner case 12.

The storehouse 1 may further include a door 20 capable of opening or closing the first storage space 15. The door 20 may be movably provided in front of the storehouse body 10.

A shelf 23 on which food is supported may be provided in the first storage space 15. For example, a plurality of shelves 23 may be vertically spaced apart from each other in the first storage space 15.

A drawer 22 that accommodates food may be provided in the first storage space 15. The drawer 22 is provided to be withdrawable. The drawer 22 may be provided in plurality. For example, the plurality of drawers 22 may be vertically spaced apart from each other in the first storage space 15.

A plurality of storage compartments may be defined by the plurality of shelves 23 or the plurality of drawers 22.

A duct 30 for supplying a fluid to the first storage space 15 may be provided on the rear wall of the first storage space 15.

The duct 30 may constitute a first passage through which the fluid flows, the first passage being provided inside of the first wall or in the vicinity of the first wall defining the first storage space 15.

The duct 30 may be located in the rear of the plurality of drawers 22.

The fluid heat-exchanged in a second storage space 16 flows through the duct 30, and a duct discharge hole 35 through which the fluid is discharged to the first storage space 15 may be defined on the front surface of the duct 30.

A plurality of duct discharge holes 35 may be defined. The plurality of duct discharge holes 35 may be disposed vertically.

The duct 30 extends in the vertical direction and is configured to have a constant width w in the front-and-rear direction. Due to the duct 30 having a constant width, the plurality of drawers 22 may be disposed vertically with the same size and shape.

The storehouse 1 may include the second storage space 16 providing a space in which a first heat exchanger E1 is accommodated.

The second storage space 16 may be partitioned from the first storage space 15 by a partition wall B1.

The partition wall B1 may constitute at least a part of the first storage space 15.

The partition wall B1 may constitute at least a part of the second storage space 16.

The partition wall B1 may constitute at least a part of the third storage space 17.

The storehouse 1 may include a third storage space 17 providing a space in which a second heat exchanger E2 is accommodated.

The first heat exchanger E1 and the second heat exchanger E2 may be separated by an insulating wall B2.

The insulating wall B2 may constitute at least a part of the second storage space 16.

The insulating wall B2 may constitute at least a part of the third storage space 17.

The storehouse 1 may include a heat exchange device 100. The heat exchange device 100 includes the first heat exchanger E1 and the second heat exchanger E2.

For example, the heat exchange device 100 may be detachably disposed at the lower portion of the storehouse body 10. However, the present disclosure is not limited thereto, and the first heat exchanger E1 and the second heat exchanger E2 may be provided separately from each other.

The second heat exchanger E2 may be disposed in the front portion of the heat exchange device 100, and the first heat exchanger E1 may be disposed in the rear portion of the heat exchange device 100.

The insulating wall B2 may be located between the first heat exchanger E1 and the second heat exchanger E2.

Two independent flows may be generated in the heat exchange device 100. The two independent flows may include a first flow f1 circulating through the first and second storage spaces 15 and 16 and a second flow f2 passing through the inside and the outside of the third storage space 17.

The heat exchange device 100 may further include a cover B3 through which the second flow f2 passes.

The cover B3 may define at least a part of the third storage space 17.

The cover B3 may include a cover inlet portion through which the fluid outside the third storage space 17 is guided to flow into the third storage space 17, and a cover discharge portion through which the fluid heat-exchanged in the third storage space 17 is discharged.

For example, outside air may be introduced from the front side to the third storage space 17 through the cover inlet portion, and may be discharged from the third storage space 17 to the front side through the cover discharge portion. However, the direction in which the outside air is introduced and discharged is not limited thereto.

The second flow f2 may be generated by a fluid generator, for example, a second fan, and may circulate through the cover inlet portion of the cover B3, the third storage space 17, and the cover discharge portion of the cover B3.

At least a part of the cover B3 may be shielded by the door 20. For example, the lower end portion of the door 20 may be formed at a position lower than the upper end portion of the cover B3.

As another example, the cover B3 may be located under the door 20. The upper end portion of the cover B3 may be formed at a position corresponding to the lower end portion of the door 20 or a position lower than the lower end portion of the door 20.

However, the relative positions of the cover B3 and the door 20 may not be limited thereto.

An inlet portion P1 through which the fluid in the first storage space 15 is introduced into the second storage space 16 and an outlet portion P2 through which the fluid heat-exchanged in the second storage space 16 is discharged to the duct 30 may be formed in the partition wall B1.

For example, the inlet portion P1 may be disposed above the front portion of the second storage space 16, and the outlet portion P2 may be disposed above the rear portion of the second storage space 16.

The first flow f1 may circulate through the inlet portion P1, the second storage space 16, and the outlet portion P2.

For example, the first heat exchanger E1 may include an evaporator.

For example, the second heat exchanger E2 may include a condenser.

The storehouse 1 may include a fluid generator disposed downstream of the first heat exchanger E1 to generate a flow. For example, the fluid generator may include a first fan F.

The first fan F may be disposed inside the second storage space 16, inside the partition wall B1, or inside the first storage space 15.

For example, the first fan F may be disposed above the first heat exchanger E1. However, the location of the first fan F is not limited thereto, and the first fan F may be provided at another location if the first fan F is disposed on the outlet side of the first heat exchanger E1.

The first fan F may be fluidly connected to the inlet portion P1 and the outlet portion P2. For example, based on the passage of the fluid, the first fan F may be provided between the inlet portion P1 and the outlet portion P2.

The fluid, which is introduced into the second storage space 16 through the inlet portion P1, and may pass through the first heat exchanger E1 and the first fan F and may circulate to the duct 30 through the outlet portion P2.

Figure 2:
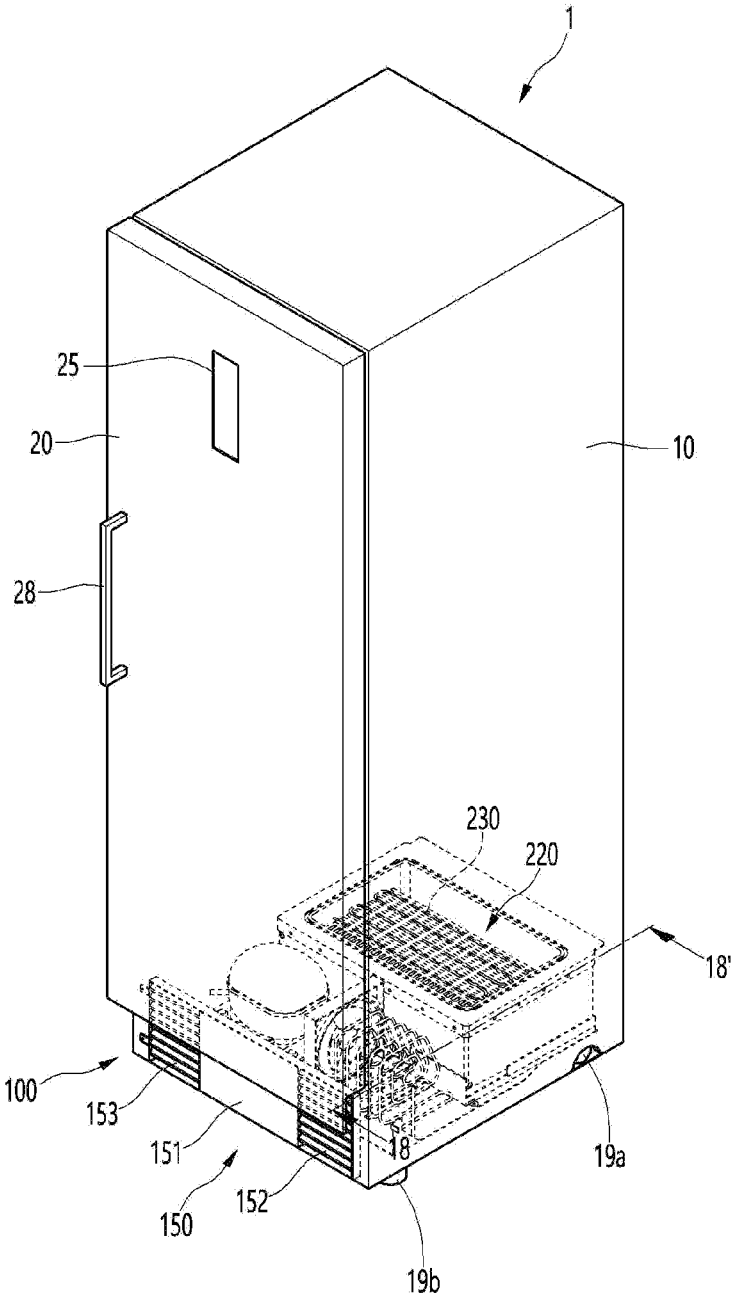
FIG. 2 is a front perspective view of the storehouse according to an embodiment of the present disclosure.
Figure 3:
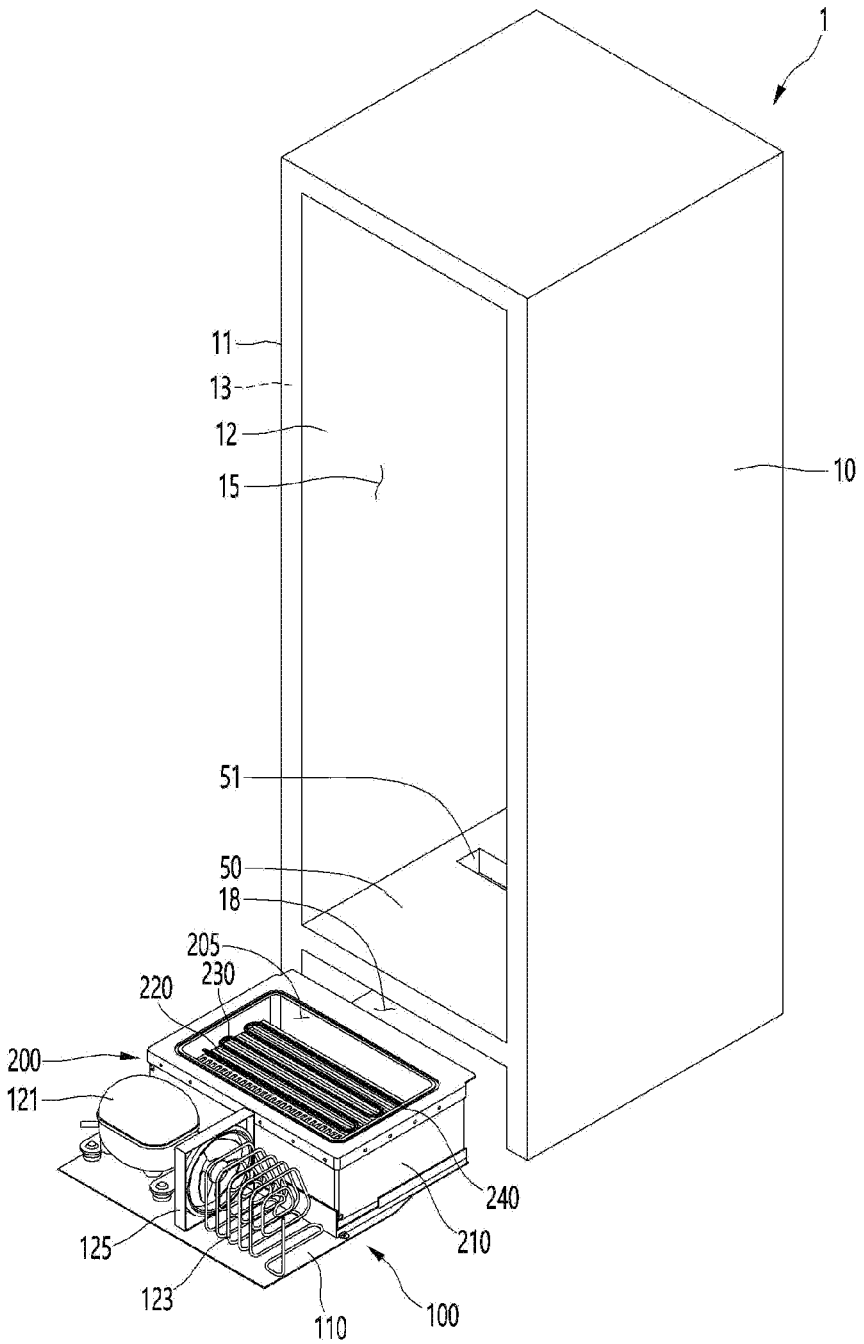
FIG. 3 is an exploded perspective view of a storehouse body and a heat exchange device according to an embodiment of the present disclosure.
Figure 4:
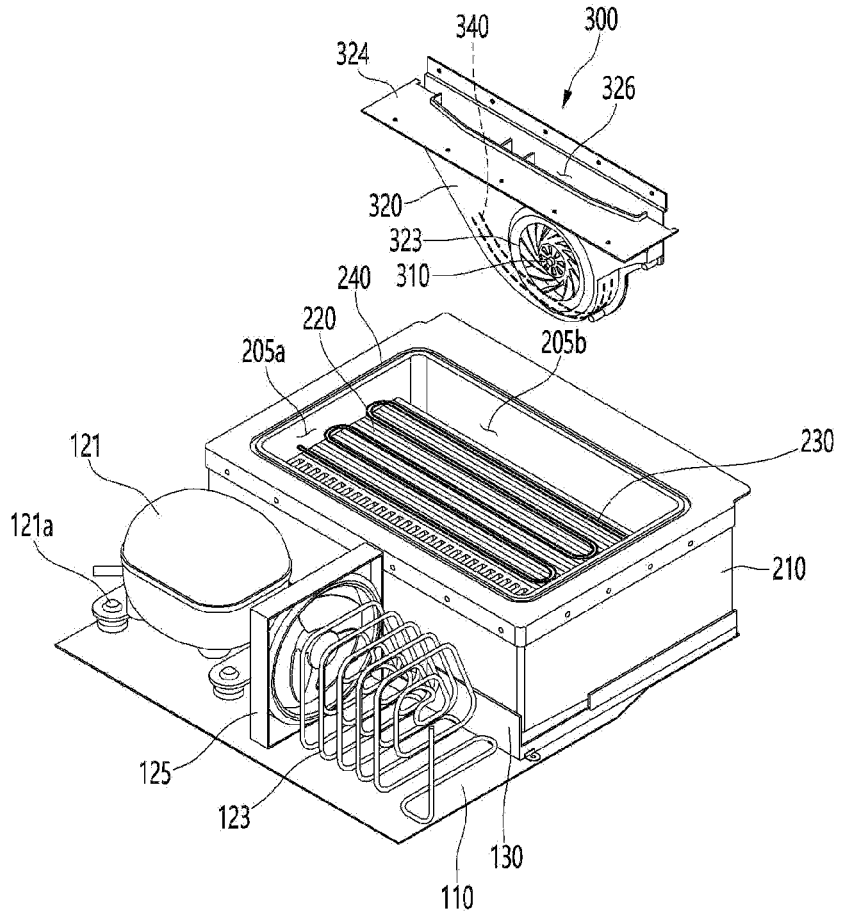
FIG. 4 is a perspective view of the heat exchange device according to an embodiment of the present disclosure.

FIG. 2 is a front perspective view of the storehouse according to an embodiment of the present disclosure, FIG. 3 is an exploded perspective view of the storehouse body and the heat exchange device according to an embodiment of the present disclosure, and FIG. 4 is a perspective view of the heat exchange device according to an embodiment of the present disclosure.

Referring to FIGS. 2 to 4, the storehouse 1 according to an embodiment of the present disclosure may include the storehouse body 10 defining the first storage space 15, and the door 20 provided in front of the storehouse body 10 to open or close the first storage space 15.

The door 20 may include a door handle 28 that allows a user to grip, and a display unit 25 that displays storehouse operation information.

The storehouse 1 may further include a heat exchange device 100 including a refrigeration cycle part.

The refrigeration cycle part may include a first heat exchanger 220 installed in a second storage space 16 as a first heat exchange portion, and a first fan 310 as a fluid generator. The fluid in the first storage space 15 may circulate through a space in which the first heat exchange portion is installed.

For example, the first heat exchanger 220 may include an evaporator, and the first fan 310 may include a cooling fan. In this case, the first heat exchange portion may constitute a cooling portion for generating cold air.

The refrigeration cycle part may include a compressor 121 and a second heat exchanger 123 as a second heat exchange portion, and a second fan 125 as a fluid generator. The fluid outside the third storage space 17 may circulate through a space in which the second heat exchange portion is installed.

For example, the second heat exchanger 123 may include a condenser, and the second fan 125 may include a condensing fan. In this case, the second heat exchange portion may constitute a heat dissipation portion that dissipates heat.

The heat exchange device 100 may be installed in a device accommodation space 18. The device accommodation space 18 may include a second storage space 16 in which the first heat exchanger 220 is installed, and a third storage space 17 in which the second heat exchanger 123 is installed.

The first storage space 15 and the device accommodation space 18 may be separated by a partition wall 50.

The partition wall 50 may be located between the first storage space 15 and the device accommodation space 18.

For example, the partition wall 50 may vertically separate the first storage space 15 and the device accommodation space 18.

For example, the partition wall 50 may constitute a part of a body inner case 12.

The partition wall 50 may include a wall insulating material 56 (see FIG. 15) for insulating the first storage space 15 and the device accommodation space 18.

The device accommodation space 18 may be located below the first storage space 15.

The device accommodation space 18 may have a smaller volume than the first storage space 15.

The heat exchange device 100 may be located at the lower end portion of the storehouse body 10.

An inlet portion 51 through which the fluid in the first storage space 15 is introduced into the second storage space 16 of the heat exchange device 100 is defined in the partition wall 50. The inlet portion 51 may pass through the partition wall 50 to communicate with the second storage space 16 of the heat exchange device 100.

The inlet portion 51 may include a hole defined to be lengthwise in the left-and-right direction.

The storehouse 1 may further include a cover 150 that is provided in front of the heat exchange device 100 and introduces the fluid from the outside of the third storage space 17.

The cover 150 may include a cover body 151 having a size corresponding to the front surface of the heat exchange device 100, a cover inlet portion 152 through which the fluid is introduced into the third storage space 17, and a cover outlet portion 153 through which the fluid passing through the third storage space 17 of the heat exchange device 100 is discharged.

The cover inlet portion 152 and the cover outlet portion 153 may be disposed on both sides of the cover body 151.

The cover inlet portion 152 may be located in front of the second heat exchanger 123. The cover outlet portion 153 may be located in front of the compressor 121.

The fluid, which is introduced into the third storage space 17 of the heat exchange device 100 through the cover inlet portion 152, may be heat-exchanged through the second heat exchanger 123 and the compressor 121 and may be discharged to the outside of the storehouse through the cover outlet portion 153.

The second heat exchange portion of the heat exchange device 100 may be disposed in the front region of the heat exchange device 100. The second heat exchange portion may include a compressor 121, a second fan 125, and a second heat exchanger 123.

The compressor 121, the second fan 125, and the second heat exchanger 123 may be disposed in the left-and-right direction. The compressor 121, the second fan 125, and the second heat exchanger 123 may be disposed in a line.

The second fan 125 may be disposed between the compressor 121 and the second heat exchanger 123.

The second fan 125 may include an axial fan.

The first heat exchange portion of the heat exchange device 100 may be disposed in the rear region of the heat exchange device 100. The first heat exchange portion may include the first heat exchanger 220 and the first fan 310.

The first heat exchange portion further includes a heat exchanger case 200 defining a space (case accommodation portion) 205 accommodating the first heat exchanger 220. The heat exchanger case 200 may be separated from the second heat exchange portion and configured to have an insulating wall.

The case accommodation portion 205 of the heat exchanger case 200 may define at least a part of the second storage space 16.

The heat exchanger case 200 includes a case body 210 provided in the rear of the second heat exchange portion. The case body 210 may have a polyhedral shape (e.g., a hexahedral shape) with an opened upper end portion.

The first heat exchanger 220 may be disposed inside the heat exchanger case 200.

The inner space of the heat exchanger case 200 may define at least a part of the second storage space 16. The heat exchanger case 200 may include a case insulating material (see 213 of FIG. 7) that insulates the inner space and the outer space of the heat exchanger case 200.

The fluid, which is heat-exchanged while passing through the first heat exchanger 220, may flow to the duct 30 of the storehouse body 10 and may be supplied to the first storage space 15 through the duct discharge hole 35.

The heat exchanger case 200 may be coupled to the storehouse body 10.

The heat exchanger case 200 may be in close contact with the partition wall 50.

The heat exchanger case 200 further includes a sealing member 240 that seals the space between the heat exchanger case 200 and the partition wall 50.

The sealing member 240 may be provided on the upper surface of the heat exchanger case 200 and may be disposed to be in contact with the bottom surface of the partition wall 50.

The sealing member 240 may include a gasket, an O-ring, or a square ring.

A sealing groove 210*e*, in which the sealing member 240 is installed, may be defined in a case top portion 210*c* of the heat exchanger case 200. The sealing groove 210*e* may be defined by being recessed in the case top portion 210*c*.

For example, the sealing groove 210*e* may have a quadrangular groove shape corresponding to the shape of the sealing member 240.

Before the heat exchanger case 200 is coupled to the first storage space 15, the sealing member 240 may protrude from the heat exchanger case 200 by a predetermined height.

After the heat exchanger case 200 is coupled to the first storage space 15, the sealing member 240 is pressed by the partition wall 50 to achieve sealing. In this process, the protruding height of the sealing member 240 may be reduced or eliminated.

The heat exchange device 100 may further include a base 110 on which at least one of the first heat exchange portion and the second heat exchange portion is installed. The base 110 may have a shape corresponding to the lower end portion of the storehouse body 10.

The base 110 may form at least a part of a common plate.

It is shown that the first and second heat exchange portions are installed on the base 110 together. However, unlike this, the first and second heat exchange portions may be installed on separate bases, and the first heat exchange portion or the second heat exchange portion may be installed on the ground without a base.

For example, when the base 110 is provided with the common plate of the first and second heat exchangers, the upper surface of the base 110 may provide the installation surface of the first and second heat exchangers, the second heat exchanger 123 may be disposed on the front portion of the installation surface, and the first heat exchanger 220 may be disposed in the rear portion of the installation surface.

The compressor 121, the second fan 125, and the second heat exchanger 123 are provided on the front portion of the installation surface. The second fan 125 may be provided between the compressor 121 and the second heat exchanger 123.

The base 110 may include a compressor support portion 121*a* that supports the compressor 121. A plurality of compressor support portions 121*a* may be provided and may be coupled to legs of the compressor 121.

The first heat exchanger 220 may be installed on the base 110. The rear portion of the base 110 may define the installation space for the first heat exchanger 220.

The heat exchange device 100 may further include a tray 130 for collecting the fluid discharged from the heat exchanger case 200, for example, water or water vapor. When the first heat exchanger 220 is configured with an evaporator, the fluid may include condensed water.

The tray 130 may include a fluid collecting surface for collecting the fluid and an edge portion protruding upward from the edge of the fluid collecting surface to prevent overflow of the fluid. The edge portion may include a wall (storage wall) that blocks the flow of collected water or water vapor so as to store the collected water or water vapor.

The heat exchanger case 200 may be seated on the upper side of the tray 130.

The heat exchange device 100 further includes a fan assembly 300 for generating the flow of the fluid passing through the first heat exchanger 220. The fan assembly 300 may be located inside the heat exchanger case 200, and may be provided on one side of the first heat exchanger 220. For example, the fan assembly 300 may be provided in the rear of the first heat exchanger 220.

A part of the fan assembly 300 may protrude upward from the heat exchanger case 200 and may be connected to the lower portion of the duct 30.

The fan assembly 300 may include the first fan 310. The first fan 310 may include a centrifugal fan.

The fan assembly 300 further includes a shroud 320 on which the first fan 310 is installed to define a passage. The shroud 320 includes a fan inlet portion 323 through which the fluid passing through the first heat exchanger 220 is introduced and a fan outlet portion 326 through which the fluid passing through the first fan 310 is discharged.

The fan inlet portion 323 may be formed on the front surface of the shroud 320, and the first fan 310 may be disposed behind the fan inlet portion 323.

The fan outlet portion 326 may be formed on the upper surface of the shroud 320. The fluid, which is introduced through the fan inlet portion 323 in the axial direction of the first fan 310, may flow upward after passing through the first fan 310 and may be discharged from the shroud 320 through the fan outlet portion 326.

The heat exchanger case 200 may be provided with a first heat exchanger heater 230 that removes the frost formed on the first heat exchanger 220.

The first heat exchanger heater 230 may be provided in the upper portion and/or the lower portion of the first heat exchanger 220.

As an example, the first heat exchanger heater 230 may be provided in the upper portion of the first heat exchanger 220.

As another example, the first heat exchanger heater 230 may be provided in the lower portion of the first heat exchanger 220.

As another example, the first heat exchanger heater 230 may be provided in the upper portion and the lower portion of the first heat exchanger 220.

The storehouse 1 may further include a roller 19*a* provided in the lower end portion of the storehouse body 10 for easy movement of the storehouse 1. The rollers 19*a* may be provided on both sides of the rear portion of the storehouse body 10.

An adjustment device 19*b* for adjusting the height (flatness) of the storehouse body 10 may be provided at the front portion of the storehouse body 10.

Figure 5:
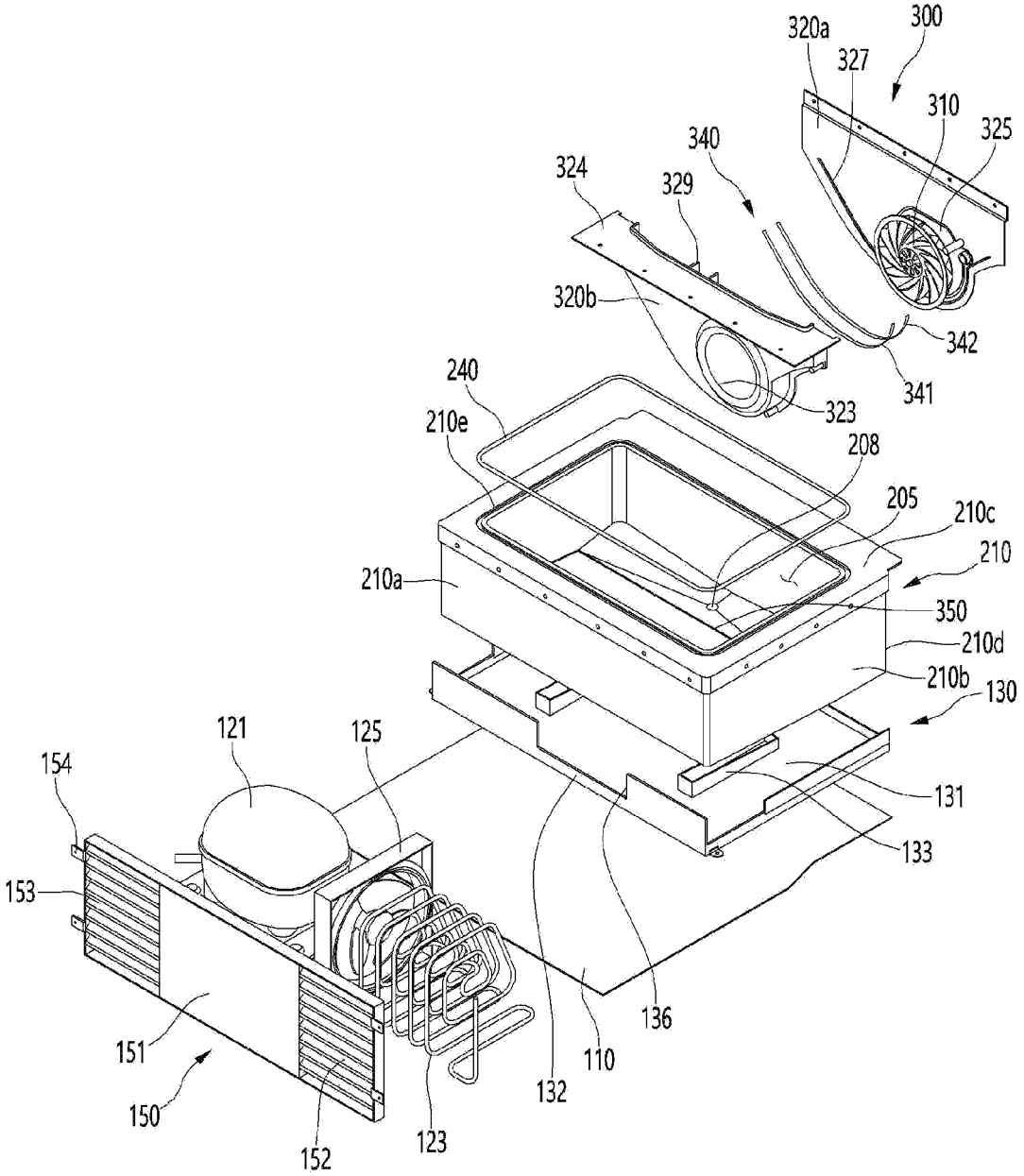
FIG. 5 is an exploded perspective view of the heat exchange device according to an embodiment of the present disclosure.
Figure 6:
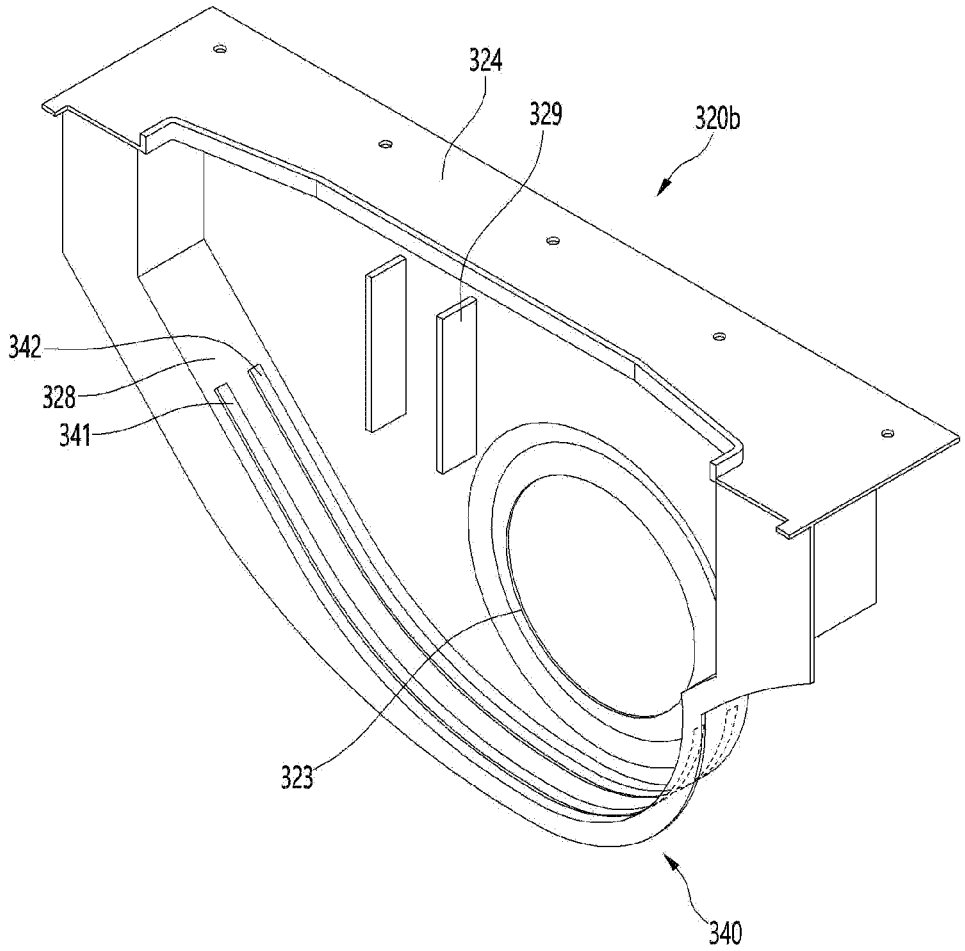
FIG. 6 is a view showing a configuration of a second part of a shroud according to an embodiment of the present disclosure.
Figure 7:
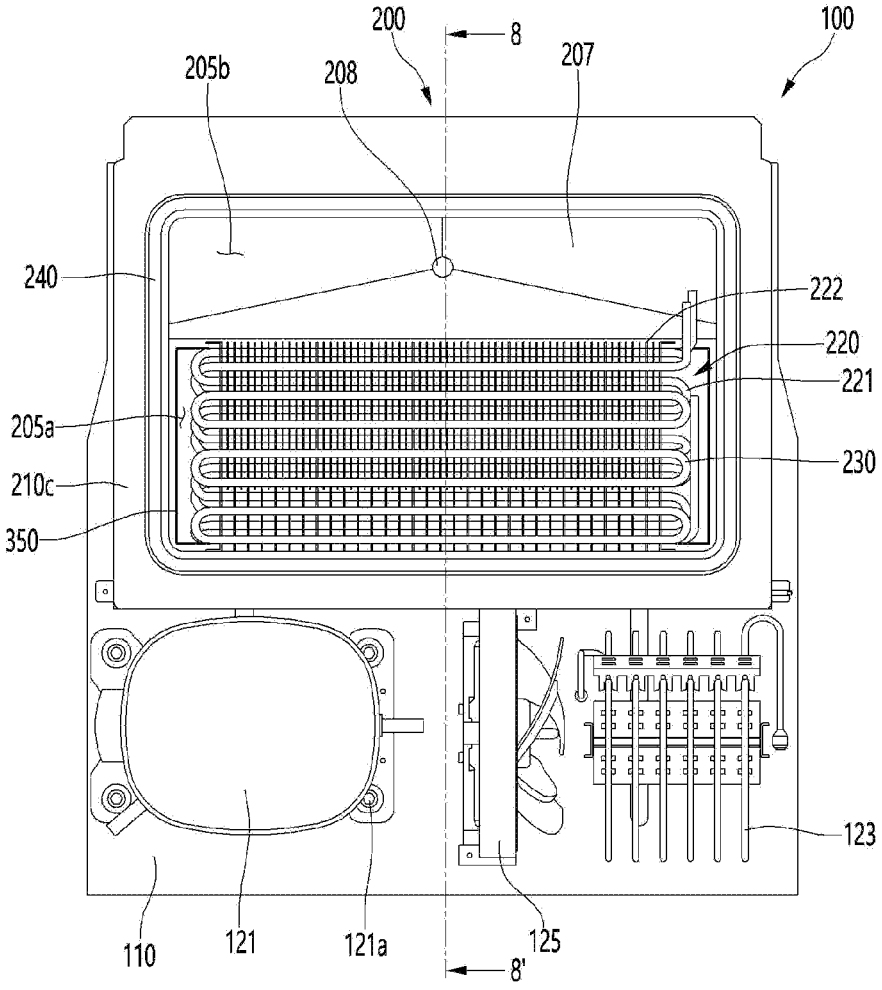
FIG. 7 is a plan view of a partial configuration of the heat exchange device according to an embodiment of the present disclosure.
Figure 8:
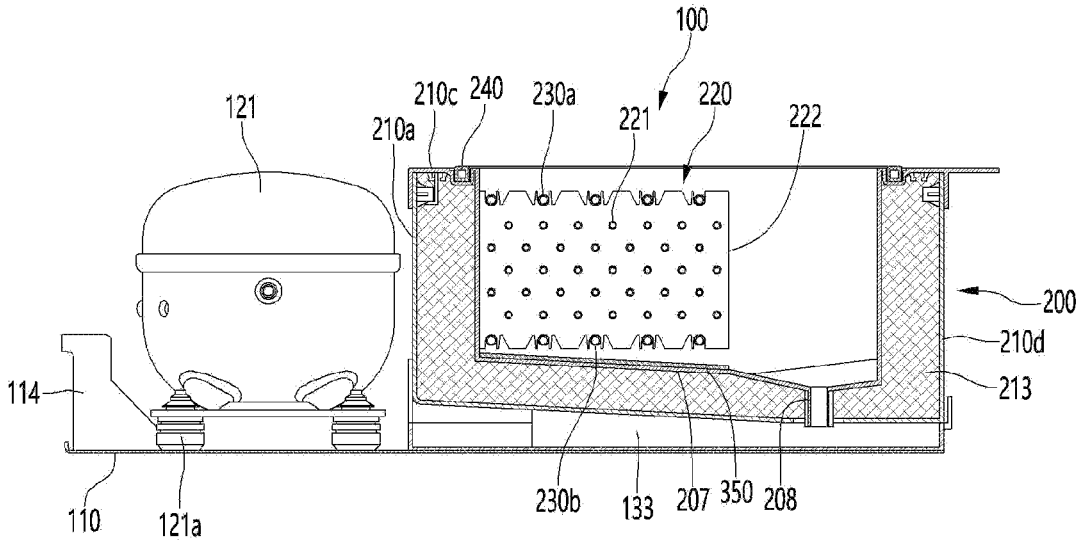
FIG. 8 is a cross-sectional view taken along line 8-8' of FIG. 7.

FIG. 5 is an exploded perspective view of the heat exchange device according to an embodiment of the present disclosure, FIG. 6 is a view showing a configuration of a second part of a shroud according to an embodiment of the present disclosure, FIG. 7 is a plan view of a partial configuration of the heat exchange device according to an embodiment of the present disclosure, and FIG. 8 is a cross-sectional view taken along line 8-8' of FIG. 7.

The configuration of the heat exchange device 100 according to an embodiment of the present disclosure will be described in more detail with reference to FIGS. 5 to 8.

The tray 130 according to an embodiment of the present disclosure may include a tray body 131 defining a fluid collecting surface. For example, the tray body 131 may have a quadrangular plate shape.

The tray 130 may further include a storage wall 132 provided on the edge of the tray body 131 and protruding upward. The storage wall 132 may prevent the fluid collected in the tray 130 from overflowing.

The tray 130 may further include a support wall 133 provided on the tray body 131 to support the heat exchanger case 200. The support wall 133 may protrude upward from the tray body 131.

A plurality of support walls 133 may be provided. The plurality of support walls 133 may be spaced apart from each other in the left-and-right direction of the tray 130.

The support wall 133 may be provided to be inclined downward to the rear. Therefore, the heat exchanger case 200 supported by the support wall 133 may be disposed to be inclined downward to the rear.

A discharge passage through which the fluid is discharged is defined in the heat exchanger case 200. For example, the discharge passage may define a drain hole 208.

A drain hole 208, through which the fluid is discharged, is defined in the bottom surface of the heat exchanger case 200. The drain hole 208 may be defined in the rear portion of the bottom surface of the heat exchanger case 200. Since the heat exchanger case 200 is disposed to be inclined downward to the rear, the fluid present in the heat exchanger case 200 may be easily discharged through the drain hole 208.

The condensed water discharged through the drain hole 208 may be collected in the tray 130.

At least some storage walls 132 of the tray 130 may support at least one of the front and rear surfaces and the left and right side surfaces of the heat exchanger case 200.

A tray recessed portion 136 may be defined in at least one of the plurality of storage walls 132 of the tray 130. At least a part of a refrigerant pipe constituting the second heat exchange portion may be configured to pass through the tray recessed portion 136.

The heat exchanger case 200 may have a hexahedral shape with an opened upper end portion. The heat exchanger case 200 may include a case front portion 210*a*, a case side portion 210*b* extending rearward from both sides of the case front portion 210*a*, a case top portion 210*c* forming the upper end portion of the heat exchanger case 200, and a case rear portion 210*d* facing the case front portion 210*a*.

The heat exchanger case 200 may include a case extension portion 215 that further extends rearward from the case top portion 210*c*.

When the heat exchanger case 200 is coupled to the storehouse body 10, that is, the first storage space 15, the case extension portion 215 may be understood as a portion located adjacent to or in contact with the lower end portion of the rear wall of the storehouse body 10.

The fan assembly 300 may include a shroud 320 on which the first fan 310 is installed. The shroud 320 may include a first part 320*a* defining a fan seat 325 on which the first fan 310 is seated.

The first part 320*a* may define the rear portion of the shroud 320, and the fan seat 325 may be defined on the front surface of the first part 320*a*.

The first part 320*a* may further include a drain guide 327 for guiding the fluid generated in the fan assembly 300 to the lower side of the fan assembly 300. The drain guide 327 may protrude from the front surface of the first part 320*a* and may extend obliquely downward toward the lower side of the first fan 310.

The shroud 320 includes a second part 320*b* coupled to the first part 320*a*. The second part 320*b* may define the front portion of the shroud 320.

The second part 320*b* may define a fan inlet portion 323 through which the fluid is introduced into the first fan 310.

The first and second parts 320*a* and 320*b* may define an installation space for the first fan 310 in the shroud 320, and may define a passage.

The shroud 320 may further include a wall coupling portion 324 defining the upper surface thereof. The wall coupling portion 324 may extend forward from the upper end portion of the second part 320*b* and may be coupled to the partition wall 50.

The wall coupling portion 324 may be provided in front of the fan outlet portion 326.

The shroud 320 may further include a support rib 329 provided inside the shroud 320 and configured to support the first part 320*a* or the second part 320*b*. The inner space of the shroud 320 may be maintained without deformation by the support rib 329.

For example, the support rib 329 may be provided to protrude from the rear surface of the second part 320*b* and disposed to be in contact with the first part 320*a*.

As another example, the support rib 329 may be provided to protrude from the rear surface of the first part 320*a* and disposed to be in contact with the second part 320*b*.

The fluid, which is introduced into the heat exchanger case 200, may pass through the first heat exchanger 220, may be introduced in the axial direction of the first fan 310, and may be discharged through the first fan 310 in the radial direction.

The fluid, which is introduced into the heat exchanger case 200, may pass through the first heat exchanger 220 and may be sucked through the first fan 310. The fluid discharged from the first fan 310 may flow through the duct 30.

A passage is defined in the heat exchanger case 200. The passage may be defined in the case accommodation portion 205 in which the first heat exchanger 220 and the fan assembly 300 are installed.

The case accommodation portion 205 may include a first accommodation space 205*a* defining an area in which the first heat exchanger 220 is installed and a second accommodation space 205*b* defining an area in which the fan assembly 300 is installed.

The first accommodation space 205*a* may be defined in the front portion of the case accommodation portion 205, and the second accommodation space 205*b* may be defined in the rear portion of the case accommodation portion 205.

The fan assembly 300 may include a fan heater 340. The fan heater 340 may provide heat to melt the ice generated in the fan assembly 300.

The fan heater 340 may include an electric heater.

The fan heater 340 may include a sheath heater or a planar heater.

The fan assembly 300 is disposed adjacent to the upper side of the drain hole 208, and there is a possibility that air outside the cooling device may be introduced into the fan assembly 300 through the drain hole 208. Accordingly, frost may be formed on the surface of the fan assembly 300. In order to melt the ice on the fan assembly 300, the fan heater 340 may be driven.

The fan heater 340 may be disposed inside the shroud 320.

The fan heater 340 may be disposed on the inner surface of the shroud 320.

The shroud 320 may include a heater seat 328 having a width in the front-and-rear direction on the outer peripheral side of the fan suction portion 323.

The heater seat 328 may be configured to surround a portion of the outer periphery of the first fan 310, and the fan heater 340 may evenly provide high-temperature heat toward the first fan 310.

The fan heater 340 may be provided on the heater seat 328. The heater seat 328 may extend roundly along the outer periphery of the first fan 310.

The fan heater 340 may be disposed along the outer periphery of the first fan 310.

The fan heater 340 may have a round shape.

The fan heater 340 may be provided on the outer periphery of the fan suction portion 323.

The fan heater 340 may include a plurality of heaters 341 and 342. The plurality of heaters 341 and 342 may be arranged in a line to the heater seat 328.

The plurality of heaters 341 and 342 may include a first fan heater 341 forming a first row on the heater seat 328 and a second fan heater 342 forming a second row. The first and second fan heaters 341 and 342 may be arranged to be spaced apart from each other.

A case heater 350 may be provided inside the heat exchanger case 200. The case heater 350 may provide heat for removing ice present on the surface of the heat exchanger case 200 or in a space between the heat exchanger case 200 and the first heat exchanger 220.

The case heater 350 may include a planar heater.

The case heater 350 may be provided on the inner surface of the heat exchanger case 200.

The case heater 350 may be provided between the inner surface of the heat exchanger case 200 and the first heat exchanger 220.

The case heater 350 may be provided on the lower surface 207 of the inner surface of the heat exchanger case 200.

The case heater 350 may be in contact with the heat exchanger case 200.

As an example, when the first heat exchanger 220 is configured as an evaporator, the first heat exchanger may include a refrigerant pipe 221 through which a refrigerant flows, and a fin 222 coupled to the refrigerant pipe 221. The refrigerant pipe 221 may be formed in multiple stages, and both sides of the refrigerant pipe 221 may have a bent shape.

A plurality of fins 222 may be provided. The plurality of fins 222 may be spaced apart from each other in the left-and-right direction. The fin 222 may extend in the front-and-rear direction.

The heat exchange surface of the fin 222 may be disposed to face the left-and-right inner surfaces of the heat exchanger case 200.

Due to the refrigerant pipe 221 and the fin 222, the first heat exchanger 220 may be configured to have a hexahedral shape as a whole. The case accommodation portion 205 may be defined by recessing downward from the upper end portion of the heat exchanger case 200 to correspond to the shape of the first heat exchanger 220.

The first heat exchanger 220 may be provided with a first heat exchanger heater 230 that generates heat in order to remove frost.

The first heat exchanger heater 230 may include an electric heater.

The first heat exchanger heater 230 may include an upper heater 230*a* provided in the upper portion of the first heat exchanger 220.

The first heat exchanger heater 230 may include a lower heater 230*b* provided in the lower portion of the first heat exchanger 220.

The second accommodation space 205*b* may be defined by recessing downward from the upper end portion of the heat exchanger case 200.

A drain hole 208, through which the fluid generated in the first heat exchanger 220 or the first fan 310 is discharged, may be defined in the heat exchanger case 200. The drain hole 208 may be defined in the inner lower surface of the heat exchanger case 200.

The drain hole 208 may be defined in the lower surface 207 of the case accommodation portion 205.

The drain hole 208 may be defined below the second accommodation space 205*b*. That is, the drain hole 208 may be defined to vertically overlap the second accommodation space 205*b*.

The lower surface 207 of the case accommodation portion 205 may be inclined downward toward the drain hole 208. Therefore, the fluid generated in the first heat exchanger 220 or the first fan 310 may fall and easily flow toward the drain hole 208.

The drain hole 208 may be defined in the central portion of the heat exchanger case 200 with respect to the left-and-right direction. That is, the distance from the drain hole 208 to the left end of the heat exchanger case 200 may be equal to the distance from the drain hole 208 to the right end of the heat exchanger case 200.

The left portion and the right portion of the heat exchanger case 200 may be symmetrical with respect to the drain hole 208.

A center line (l1) in the front-and-rear direction passing through the center of the first heat exchanger 220 may pass through the center of the heat exchanger case 200.

The center line in the front-and-rear direction passing through the center of the first heat exchanger 220 may pass through the center of the drain hole 208.

The cover 150 may constitute at least a part of the third wall of the third storage space 17.

The cover 150 may define the lower appearance of the storehouse 1 when the door 20 is opened.

Coupling brackets 154 coupled to the side walls of the device accommodation space 18 may be provided on both sides of the cover 150. The coupling brackets 154 may protrude outward from both ends of the cover body 151.

A plurality of coupling brackets 154 may be provided at the side end portion of the cover body 151 and spaced apart from each other in the vertical direction.

For example, the coupling bracket 154 may define a coupling hole, and a predetermined coupling member may be inserted into the coupling hole and coupled to the side wall of the device accommodation space 18.

The height of the upper end portion of the cover 150 may correspond to the height of the bottom of the partition wall 50. The opened front end portion of the device accommodation space 18 may be shielded by the cover 150.

Figure 9:
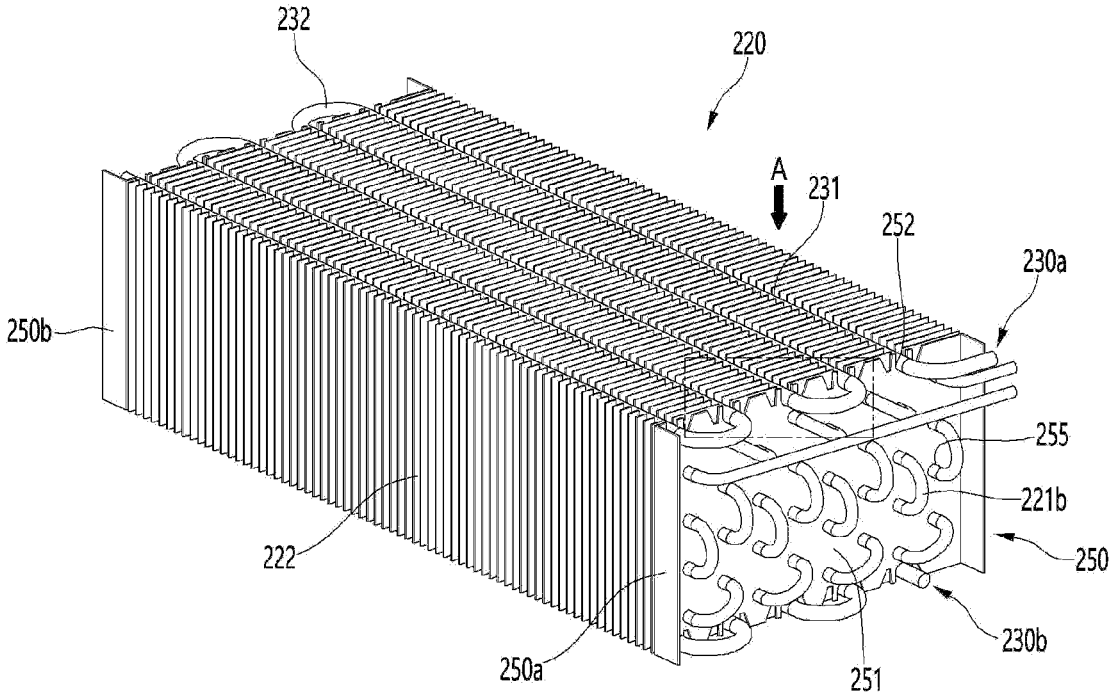
FIG. 9 is a perspective view showing a configuration of a first heat exchanger according to an embodiment of the present disclosure.
Figure 10:
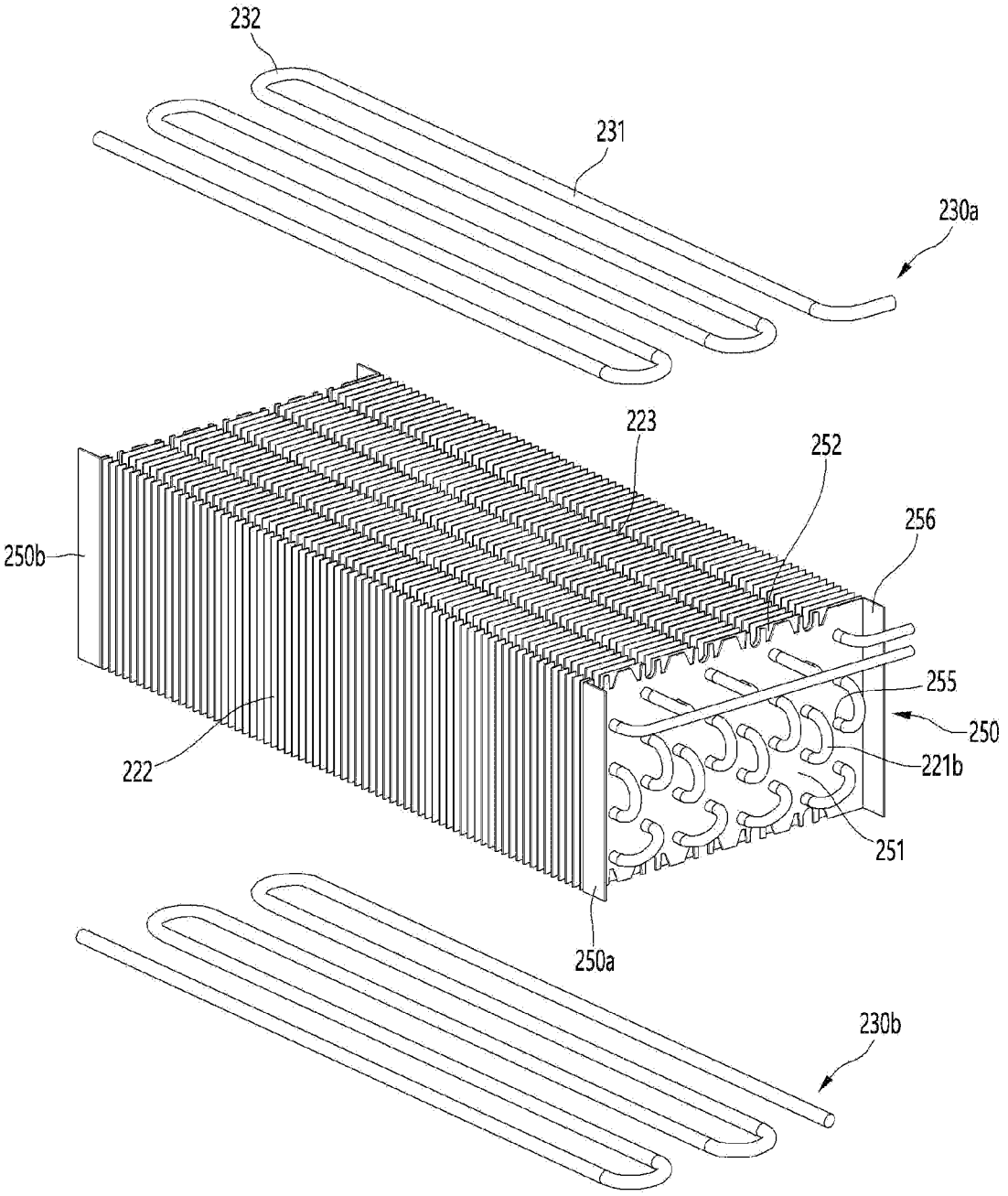
FIG. 10 is an exploded perspective view showing a configuration of a first heat exchanger in which a defrost heater is disassembled, according to an embodiment of the present disclosure.

FIG. 9 is a perspective view showing a configuration of a first heat exchanger according to an embodiment of the present disclosure, and FIG. 10 is an exploded perspective view showing the configuration of the first heat exchanger in which a defrost heater is disassembled, according to an embodiment of the present disclosure.

Referring to FIGS. 9 and 10, a first heat exchanger heater 230 according to an embodiment of the present disclosure may be provided in a first heat exchanger 220.

The first heat exchanger heater 230 may be coupled to the first heat exchanger 220.

The first heat exchanger heater 230 may be press-fitted (interference-fitted) to the first heat exchanger 220.

The first heat exchanger 220 may include a refrigerant pipe 221 through which a refrigerant flows, and a fin 222 coupled to the refrigerant pipe 221. A plurality of fins 222 may be provided, and the refrigerant pipe 221 may be disposed to pass through the plurality of fins 222.

The fin 222 may form a through hole through which the refrigerant pipe 221 passes.

The plurality of fins 222 may be spaced apart from each other and disposed in a direction in which the refrigerant pipe 221 extends.

Referring to FIG. 9, the refrigerant pipe 221 may include a straight pipe portion 221*a* passing through the fin 222 and extending in the left-and-right direction, and bending portions 221*b* provided on both sides of the straight pipe portion 221*a* and bent or rounded to change the flow direction of the refrigerant.

The bending portion 221*b* may be configured as a U-type tube to have a U shape.

The refrigerant pipe 221 may have a shape repeatedly extending from the left to right and the right to left of the first heat exchanger 220 due to the configuration of the straight pipe portion 221*a* and the bending portion 221*b*.

The refrigerant pipe 221 may be arranged in multiple stages in the vertical direction.

The refrigerant pipe 221 may be arranged in multiple stages in the front-and-rear direction.

The first heat exchanger 220 may further include support plates 250 provided on both sides of the plurality of fins 222 to support the refrigerant pipe 221.

The support plate 250 may include a plate body 251 that shields the outside of the fin 222.

The support plate 250 may form a pipe penetration portion 255 through which the refrigerant pipe 221 passes. The refrigerant pipe 221 may protrude to the outside of the plate body 251 through the pipe penetration portion 255.

The bending portion 221*b* of the refrigerant pipe 221 may protrude from the plate body 251 in the outside of the pipe penetration portion 255.

The support plate 250 may include a first plate 250*a* provided on one side of the plurality of fins 222 and a second plate 250*b* provided on the other side of the plurality of fins 222.

The refrigerant pipe 221 may protrude to the outside of the first plate 250*a*. For example, one bending portion 221*b* of the refrigerant pipe 221 may protrude to the outside of the first plate 250*a*.

The refrigerant pipe 221 may protrude to the outside of the second plate 250*b*. For example, the other bending portion 221*b* of the refrigerant pipe 221 may protrude to the outside of the second plate 250*b*.

The first heat exchanger 220 may be provided with a first heat exchanger heater 230 that provides heat to melt ice formed on the refrigerant pipe 221 or the fins 222.

A plurality of first heat exchanger heaters 230 may be provided in the first heat exchanger 220.

The first heat exchanger heater 230 may include an upper heater 230*a* (first heater) provided in the upper portion of the first heat exchanger 220. The upper heater 230*a* may be provided above the refrigerant pipe 221.

The first heat exchanger heater 230 may include a lower heater 230*b* (second heater) provided in the lower portion of the first heat exchanger 220. The lower heater 230*b* may be provided below the refrigerant pipe 221.

The upper heater 230*a* and the lower heater 230*b* may have the same configuration or substantially the same configuration.

Since the upper heater 230*a* and the lower heater 230*b* are respectively provided in the upper portion and the lower portion of the first heat exchanger 220 to transfer heat, the defrost performance of the first heat exchanger 220 may be improved.

The first heat exchanger heater 230 may include a first heater 231 that is coupled to the plurality of fins 222 and a second heater 232 that is provided on both sides of the first heater 231 and is bent or curved. The first heater 231 may be referred to as a "heater straight pipe portion" and the second heater 232 may be referred to as a "heater bending portion".

The first heater 231 may be seated on or inserted into the fin 222.

The second heater 232 may be configured as a heater having a U shape.

The first heat exchanger heater 230 may have a shape repeatedly extending from the left to right and the right to left of the first heat exchanger 220 due to the configuration of the first and second heaters 231 and 232.

A heater groove 223 in which the first heat exchanger heater 230 is disposed may be formed in the fin 222. The heater groove 223 may be configured to be recessed at the edge of the fin 222.

The first heat exchanger heater 230 may be press-fitted (interference-fitted) to the heater groove 223.

The heater groove 223 may include an upper heater groove recessed from the upper end portion of the fin 222. The upper heater 230*a* may be inserted into or seated on the upper heater groove.

The heater groove 223 may include a lower heater groove recessed from the lower end portion of the fin 222. The lower heater 230*b* may be inserted into or seated on the lower heater groove.

The fin 222 may form a predetermined seating surface so that the first heat exchanger heater 230 can be stably seated thereon. At least a portion of the seating surface may be bent so as to support the outer surface of the first heat exchanger heater 230. For example, the outer surface of the first heat exchanger heater 230 may form a circular shape.

As the first heat exchanger heater 230 is disposed to be in contact with the fins 222, heat generated from the first heat exchanger heater 230 may be transferred to the fins 222 or the refrigerant pipe 221 by conduction. Accordingly, heat transfer efficiency may be improved.

The first heat exchanger heater 230 may be supported by the support plate 250.

The support plate 250 may form a plate groove 252 on which the first heat exchanger heater 230 is seated.

The plate groove 252 may be formed by being recessed from the edge of the support plate 250.

The support plate 250 may include a plate body 251 forming a pipe penetration portion 255 into which the refrigerant pipe 221 is inserted, and a plate groove 252 recessed in the edge of the plate body 251.

The pipe penetration portion 255 may be arranged in multiple stages in the front-and-rear direction or the vertical direction.

The first heat exchanger heater 230 may be press-fitted (interference-fitted) to the plate groove 252.

The plate groove 252 may include an upper groove recessed from the upper end portion of the support plate 250. The upper heater 230*a* may be seated on the upper groove.

The plate groove 252 may include a lower groove recessed from the lower end portion of the support plate 250. The lower heater 230*b* may be seated on the lower groove.

A plurality of pipe penetration portions 255 may be formed to correspond to points where the bending portions 221*b* of the refrigerant pipe 221 are connected. The pipe penetration portion 255 may be formed to pass through the plate body 251.

The support plate 250 may further include plate bent portions 256 provided on both sides of the plate body 251. The plate bent portion 256 may extend from both sides of the plate body 251 in an outward direction of the evaporator.

The plate bent portion 256 may prevent the first heat exchanger 220 from being damaged due to interference or impact with external components.

A coupling member may be coupled to the plate bent portion 256 so that the first heat exchanger 220 is fixed to the inside of the heat exchanger case 200.

Figure 11:
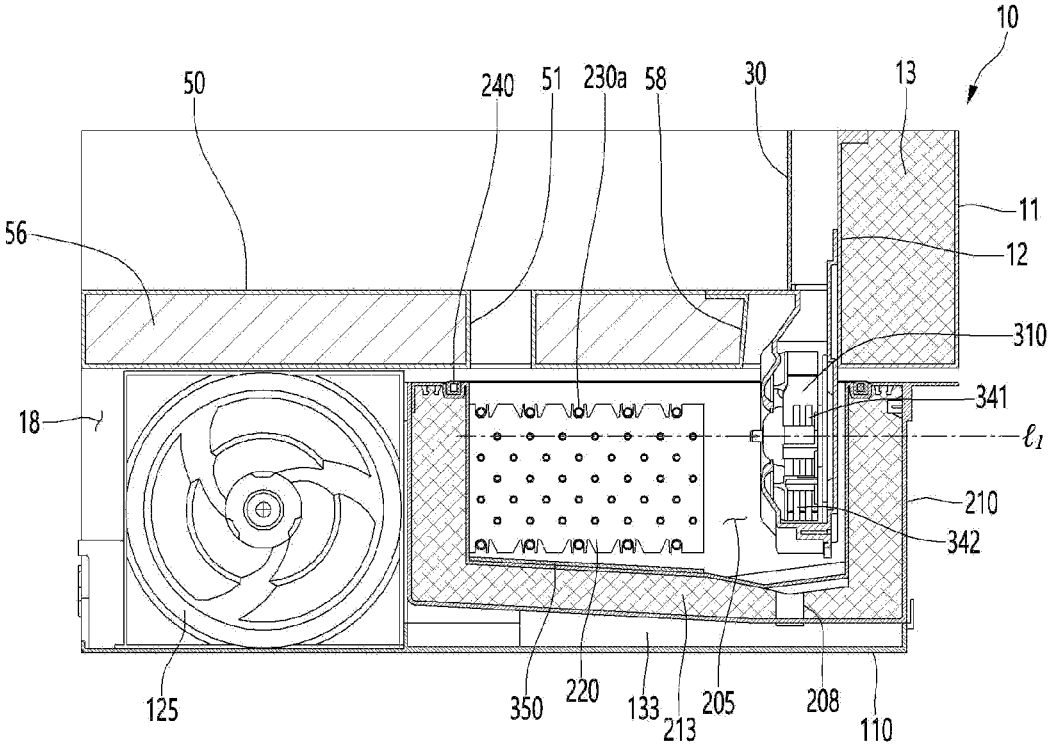
FIG. 11 is a cross-sectional view showing a state in which the heat exchange device is disposed in a device accommodation space, according to an embodiment of the present disclosure.
Figure 12:
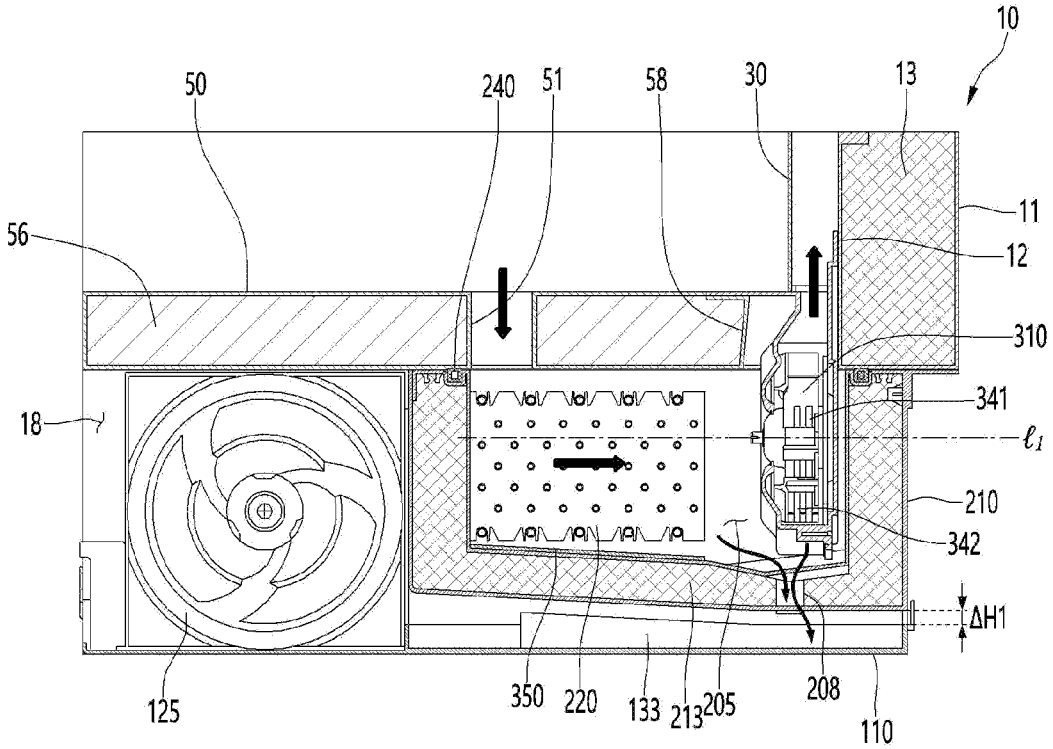
FIG. 12 is a cross-sectional view showing a state in which the heat exchanger case is in contact with a partition wall, according to an embodiment of the present disclosure.

FIG. 11 is a cross-sectional view showing a state in which the heat exchange device is disposed in a device accommodation space, according to an embodiment of the present disclosure, and FIG. 12 is a cross-sectional view showing a state in which the heat exchanger case is in contact with a partition wall, according to an embodiment of the present disclosure.

Referring to FIGS. 11 and 12, a first heat exchanger 220 may be disposed in a case accommodation portion 205 of a heat exchanger case 200. The first heat exchanger 220 may be located in the front portion of the case accommodation portion 205, that is, in the first accommodation space 205*a*.

The heat exchanger case 200 in which the first heat exchanger 220 is installed and the heat dissipation part are installed on the base 110. The heat dissipation part may include a compressor 121, a second heat exchanger 123, and a second fan 125.

The compressor 121, the second heat exchanger 123, and the second fan 125 may be arranged at the front portion of the base 110 in the left-and-right direction.

The heat exchanger case 200 may be disposed behind the heat dissipation part.

The first heat exchanger 220 and the heat dissipation part are parts constituting the refrigeration cycle and may be connected through the refrigerant pipe. The refrigerant pipe may be connected to the first heat exchanger 220, the compressor 121, and the second heat exchanger 123 by soldering.

When the manufacturing of the heat exchange device 100 is completed after the refrigerant pipe is soldered, the heat exchange device 100 may be disposed in the storehouse body 10.

The heat exchange device 100 may be inserted through the opened front end portion of the device accommodation space 18.

The heat exchange device 100 may slide into the device accommodation space 18.

As another example, the heat exchange device 100 may be fixed at a predetermined position, the storehouse body 10 may be moved toward the heat exchange device 100 by the roller 19*a* (see FIG. 2), and the heat exchange device 100 may be inserted into the device accommodation space 18.

In a state in which the heat exchange device 100 is inserted into the device accommodation space 18, the fan assembly 300 may be assembled to the storehouse body.

The partition wall 50 of the storehouse body 10 may include an outlet portion through which the fluid inside the heat exchanger case 200 is discharged to the first storage space 15.

The fan assembly 300 may include a fan outlet portion 326 communicating with the outlet portion. The fan outlet portion 326 may be connected to the duct 30.

The first fan 310 of the fan assembly 300 may be located in the rear of the first heat exchanger 220, that is, in the second accommodation space 205*b*.

An inlet portion 51, through which the cold air in the first storage space 16 is introduced into the heat exchange device 100, may be defined in the partition wall 50. The inlet portion 51 may be defined in front of the fan outlet portion 326.

The inlet portion 51 may be defined by cutting the partition wall 50 to be long in a horizontal direction.

The inlet portion 51 may be defined above the first heat exchanger 220.

The inlet portion 51 may be defined at a position corresponding to the front portion or the front end portion of the first heat exchanger 220. The front portion or the front end portion of the first heat exchanger 220 may define the inlet side of the first heat exchanger 220.

The coupling portion 53 for coupling the heat exchanger case 200 may be formed in the partition wall 50.

The heat exchanger case 200 may be disposed to be in contact with the partition wall 50.

The heat exchanger case 200 and the partition wall 50 may be sealed by the sealing member 240 provided on the case top portion 210*c* of the heat exchanger case 200.

Referring to FIG. 11, when the heat exchange device 100 according to the embodiment of the present disclosure is inserted into the device accommodation portion 18 and the fan assembly 300 is disposed, the heat exchanger case 200 may be disposed adjacent to the partition wall 50.

The front end portion of the inlet portion 51 defined in the partition wall 50 may be aligned with the front end portion of the first heat exchanger 220. The front end portion of the first heat exchanger 220 may form the inlet side through which the fluid to be heat-exchanged flows into the first heat exchanger.

The upper end portion of the heat exchanger case 200 may be in a state of being spaced downward apart from the bottom surface of the partition wall 50, and the sealing member 240 installed in the heat exchanger case 200 may be in a state of not being in contact with the bottom surface of the partition wall 50.

The first fan 310 provided in the fan assembly 300 may be disposed at the outlet side of the first heat exchanger 220.

The first fan 310 may suck cold air from the front side in the axial direction and discharge the cold air in the radial direction. The outlet portion of the first fan 310 may communicate with a discharge portion 58 of the partition wall 50 and the duct 30.

The discharge portion of the first fan 310 may be formed below the discharge portion 58. The duct 30 may be disposed above the discharge portion 58.

An axis line (l1) of the first fan 310 may extend in the front-and-rear direction and may be disposed to pass through the first heat exchanger 220. The axis line (l1) of the first fan 310 may overlap the first heat exchanger 220 in the front-and-rear direction.

Referring to FIG. 12, by moving the heat exchanger case 200 toward the partition wall 50, the partition wall 50 and the heat exchanger case 200 may be disposed to be in contact with each other. The heat exchanger case 200 may move until the sealing member 240 comes into contact with the partition wall 50.

The heat exchanger case 200 may move toward the partition wall 50 by a first distance ΔH1. As the heat exchanger case 200 moves upward, the bottom surface of the heat exchanger case 200 may be spaced upward apart from the support wall 133 supporting the heat exchanger case 200.

As the heat exchanger case 200 moves, a gap between the heat exchanger case 200 and the partition wall 50 may be reduced. While the sealing member 240 is disposed to be in contact with the partition wall 50, the protruding height of the sealing member 240 may decrease or disappear. The gap is sealed by the sealing member 240 to prevent cold air in the heat exchanger case 200 from leaking out to the outside of the duct 30.

Various means for moving and coupling the heat exchanger case 200 toward the partition wall 50 may be proposed.

For example, the heat exchanger case 200 may be coupled to the partition wall 50. In detail, a predetermined coupling member may pass through the partition wall 50 and may be coupled to the upper surface of the heat exchanger case 200.

As another example, a lifting device may be provided around the heat exchanger case 200 to lift the heat exchanger case 200 toward the partition wall 50.

As another example, a hook device may be provided on the heat exchanger case 200 or the storehouse body 10 so that the heat exchanger case 200 is caught on the storehouse body 10.

The cold air in the first storage space 15 may be introduced into the inside of the heat exchanger case 200 through the inlet portion 51 of the partition wall 50, and may pass through the first heat exchanger 220. In the process of passing through the first heat exchanger 220, the cold air may flow from the front portion to the rear portion of the first heat exchanger 220.

The fluid in the first storage space 15 may be introduced into the inside of the second storage space, for example, the inside of the heat exchanger case 200, through the inlet portion 51 of the partition wall 50, and may pass through the first heat exchanger 220. In the process of passing through the first heat exchanger 220, the fluid may flow from the front portion to the rear portion of the first heat exchanger 220.

The fluid passing through the first heat exchanger 220 may pass through the first fan 310, and the fluid passing through the first fan 310 may be discharged from the fan assembly 300 through the fan outlet portion 326 of the shroud 320 and may flow into the duct 30.

Fluids such as water and water vapor may be generated in the first heat exchanger 220, or defrost water may be generated as ice formed during a defrosting operation melts. A fluid may be generated in the fan assembly 300. The fluid may include condensed water or defrost water.

The fluid fw may fall to the bottom portion 207 forming the fluid collection of the heat exchanger case 200 and may flow to the drain hole 208 along the inclined bottom portion 207. The condensed water discharged from the drain hole 208 may fall to the tray 130 under the heat exchanger case 200 and may be collected.

Figure 13:
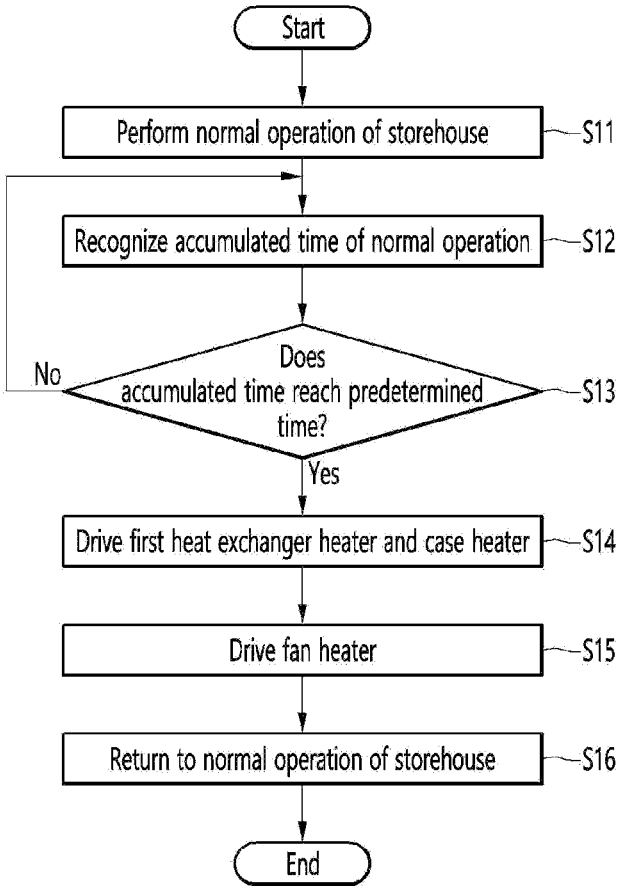
FIG. 13 is a flowchart showing a control method of a refrigerator, according to an embodiment of the present disclosure.

FIG. 13 is a flowchart showing a control method of a refrigerator, according to an embodiment of the present disclosure.

The control method of the storehouse according to the embodiment of the present disclosure will be described with reference to FIG. 13. The storehouse may include a controller configured to control the driving of the first and second fans 310 and 125, the compressor 121, and the heaters 230, 340, and 350.

The controller may perform a normal operation of the storehouse. The normal operation of the storehouse may be understood as an operation in which the fluid is circulated in the storage space and the heat exchange device 100 by the driving of the fans.

When the normal operation of the storehouse is performed, the compressor 121 may be driven and the second fan 125 and the first fan 310 may be driven.

When the second fan 125 is driven, outside air may flow toward the second heat exchanger 123 of the heat exchange device 100 and may be heat-exchanged and then discharged.

When the first fan 310 is driven, the fluid heat-exchanged in the first heat exchanger 220 may be supplied to the storage space 15 through the first fan 310, and the fluid in the first storage space 15 may be introduced into the heat exchanger case 200 and exchange heat with the first heat exchanger 220. Such a fluid circulation may be performed continuously (S11).

The normal operation time of the storehouse is accumulated, and the accumulated time may be recognized. When the accumulated time reaches a predetermined time, the defrosting operation inside the heat exchanger case 200 may be performed (S12 and S13).

The defrosting operation may be performed so that the heaters 230 and 350 provided in the first heat exchanger are driven first. The heaters 230 and 350 include a first heat exchanger heater 230 and a case heater 350, and may be collectively referred to as a "first driving heater".

The heaters 230 and 350 may be understood as heaters for removing ice formed on the inner surfaces of the first heat exchanger 220 and the heat exchanger case 200.

For example, the first heat exchanger heater 230 and the case heater 350 may be driven together and may be terminated together.

As another example, the first heat exchanger heater 230 and the case heater 350 may be driven together, and one of the first heat exchanger heater 230 and the case heater 350 may be terminated earlier.

As another example, one of the first heat exchanger heater 230 and the case heater 350 may be driven earlier and the other thereof may be driven later. In addition, the driving of the first heat exchanger heater 230 and the case heater 350 may be terminated together.

As another example, one of the first heat exchanger heater 230 and the case heater 350 may be driven earlier and the other thereof may be driven later. The driving of the first heat exchanger heater 230 and the case heater 350 may be terminated at different times.

The driving of the first heat exchanger heater 230 and the case heater 350 may be terminated when the temperature value of the temperature sensor provided in the first heat exchanger 220 is equal to or greater than a predetermined temperature (S14).

When the driving of the first heaters 230 and 350 is completed, the fan heater 340 may be driven to remove ice formed on the fan assembly 300. The fan heater 340 may be referred to as a "second driving heater".

Since outside air is introduced into the fan assembly 300 disposed adjacent to the drain hole 208, frost may be easily formed. Accordingly, the fan assembly 300 may be easily defrosted by driving the fan heater 340.

The internal temperature of the heat exchanger case 200 is raised to a high temperature by the driving of the first heaters 230 and 350. Therefore, even if the output of the fan heater 340 is kept relatively low when the fan heater 340 is additionally driven, the ice formed on the fan assembly 300 can be sufficiently removed.

The output of the fan heater 340 may be less than the sum of the outputs of the first heat exchanger heater 230 and the case heater 350.

For example, the output of the fan heater 340 may be greater than the output of the first heat exchanger heater 230 or the case heater 350, and may be less than the sum of the outputs of the first heat exchanger heater 230 and the case heater 350.

As another example, the output of the fan heater 340 may be greater than one of the outputs of the first heat exchanger heater 230 and the case heater 350 and less than the other thereof.

As another example, the output of the fan heater 340 may be less than the output of the first heat exchanger heater 230 or the case heater 350.

The driving of the fan heater 340 may be terminated when the temperature value of the temperature sensor provided in the fan assembly 300 is equal to or greater than a predetermined temperature (S15).

When the driving of the fan heater 340 is completed, it is possible to return to the normal operation of the storehouse performed in operation S11 (S16).

Operations S11 to S16 may be repeated while the power of the storehouse is turned on.

Figure 14A:
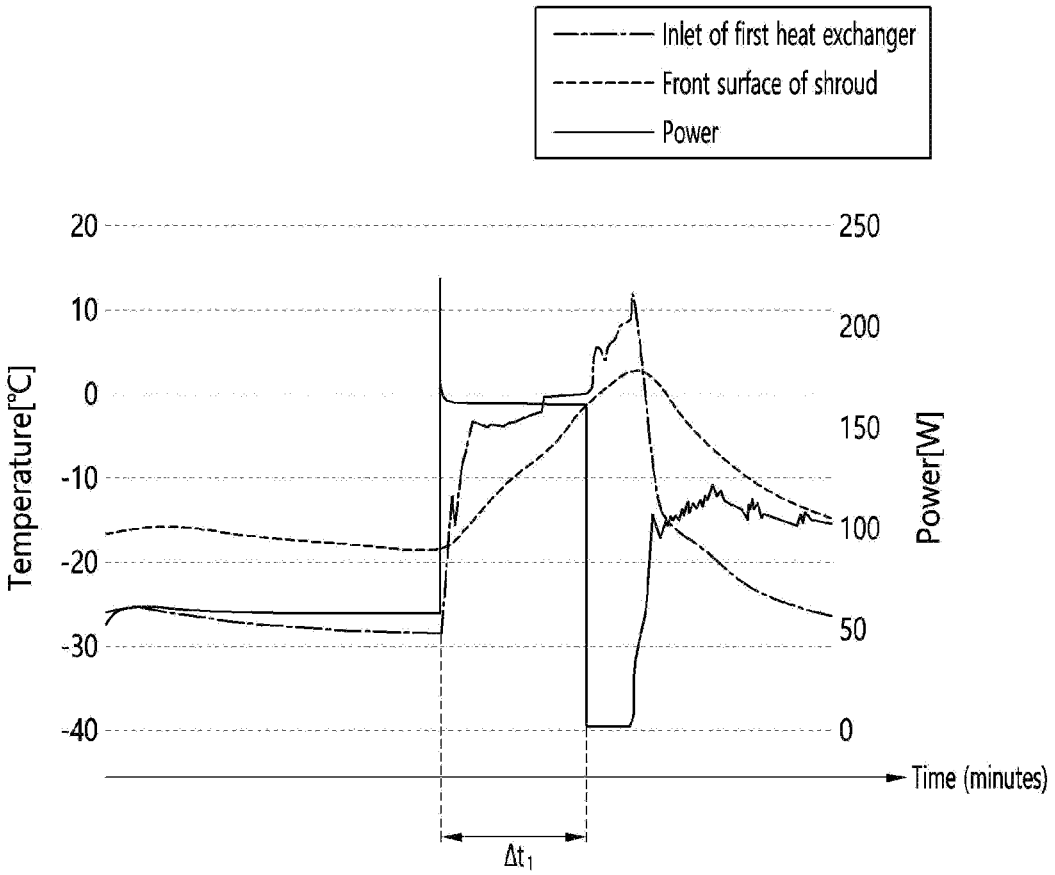
FIG. 14A is an experimental graph showing temperature values for each component position when a fan heater is not installed in a fan assembly.
Figure 14B:
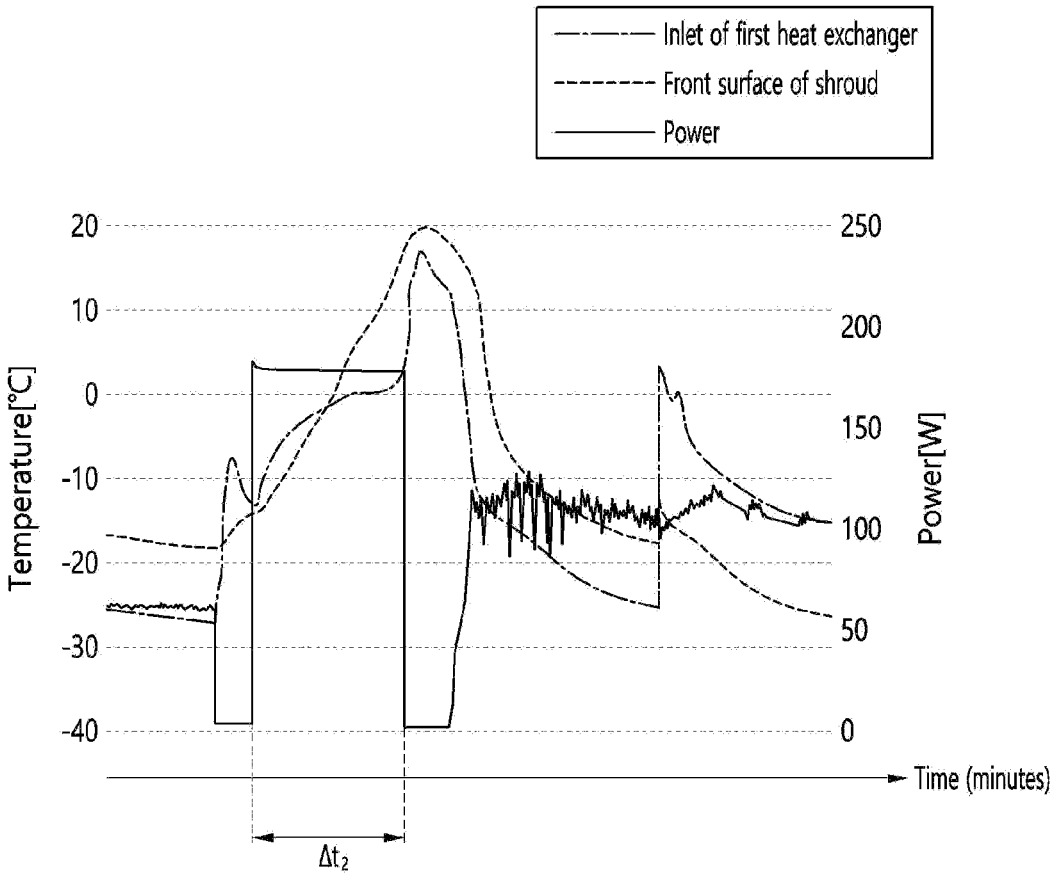
FIG. 14B is an experimental graph showing temperature values for each component position when a fan heater is installed in a fan assembly, according to an embodiment of the present disclosure.

FIG. 14A is an experimental graph showing temperature values for each component position when a fan heater is not installed in a fan assembly, and FIG. 14B is an experimental graph showing temperature values for each component position when a fan heater is installed in a fan assembly, according to an embodiment of the present disclosure.

FIG. 14A shows temperature values of main components when the defrosting operation is performed in a state in which the fan heater 340 is removed while maintaining the other structure in the fan assembly 300, according to the embodiment of the present disclosure.

Referring to FIG. 14A, when the first heaters 230 and 350 provided in the first heat exchanger 220 are driven for a predetermined time period Δt1, the inlet temperature of the first heat exchanger 220 and the temperature on the front surface of the shroud 320 may gradually increase.

Here, the front surface of the shroud 320 may be understood as one surface of the second part 320*b* on which the fan suction portion 323 is formed.

However, it can be seen that the inlet temperature (maximum temperature of about 12° C. of the first heat exchanger 220 rises relatively high, but the temperature (maximum temperature of about 4° C.) on the front surface of the shroud 320 rises relatively low. Therefore, when a lot of is formed on the fan assembly 300, there is a possibility that fan assembly 300 may not be defrosted.

On the other hand, referring to FIG. 14B, when the first heaters 230 and 350 provided on the side of the first heat exchanger 220 and the second heater 340 provided on the side of the fan assembly 300 are driven for a predetermined time period Δt2, the inlet temperature of the first heat exchanger 220 and the temperature on the front surface of the shroud 320 may gradually increase.

In detail, it can be seen that the inlet temperature (maximum temperature of about 17° C. of the first heat exchanger 220 and the temperature (maximum temperature of about 20° C.) on the front surface of the shroud 320 rise relatively high. Therefore, when a lot of is formed on the fan assembly 300, the fan assembly 300 may be defrosted.

As such, by driving the first heaters 230 and 350 disposed on the side of the first heat exchanger 220 and the second heater 340 disposed on the side of the fan assembly 300 together, the internal temperature of the heat exchanger case 200 may rise during the defrosting operation, thereby improving the efficiency of the defrosting operation.

INDUSTRIAL APPLICABILITY

According to an embodiment of the present disclosure, first and second storage spaces are fluidly connected to each other. Therefore, the fluid heat-exchanged in a first heat exchanger may be easily supplied to the first storage space, and the fluid in the first storage space may be easily returned to the second storage space. Therefore, the industrial applicability is remarkable.

The invention claimed is:

1. A storehouse comprising:

a first space configured to provide a space in which goods are stored;

a second space configured to provide a space in which a first heat exchanger is accommodated, the second space being fluidly connected to the first space;

a third space configured to provide a space in which a second heat exchanger is accommodated;

a first wall defining at least a part of the first space;

a second wall defining at least a part of the second space;

a third wall defining at least a part of the third space;

a fan assembly disposed downstream of the first heat exchanger and configured to generate a flow of fluid;

a heat exchanger case forming the second space and having an inner surface; and first and second heaters provided in the first heat exchanger, wherein at least one of the first wall or the second wall includes a partition wall to separate the first space from the second space, and wherein the first heat exchanger includes:

a first portion to face the partition wall and in which the first heater is disposed; and a second portion to face the inner surface of the heat exchanger case and in which the second heater is disposed.

2. The storehouse of claim 1, further comprising a fan heater provided in the fan assembly, wherein the fan assembly comprises:

an impeller; and a shroud configured to accommodate the impeller and having a heater seat on which the fan heater is installed.

3. The storehouse of claim 2, wherein the fan heater is disposed along an outer periphery of the impeller.

4. The storehouse of claim 2, wherein the shroud comprises:

a first shroud having a fan seat on which the impeller is placed; and a second shroud defining an accommodation space of the impeller together with the first shroud and forming a fan suction inlet into which fluid passing through the first heat exchanger is introduced.

5. The storehouse of claim 2, wherein at least a portion of the impeller is located inside the heat exchanger case.

6. The storehouse of claim 2, wherein the first heat exchanger and the impeller are arranged in a first direction, and wherein the heater seat defines a width of the shroud in the first direction so as to surround a portion of an outer periphery of the impeller.

7. The storehouse of claim 2, wherein the fan heater comprises first and second fan heaters arranged in a line along the heater seat of the shroud.

8. The storehouse of claim 1, wherein the heat exchanger case forms a discharge passage through which the fluid is discharged, and wherein the fan assembly is disposed adjacent to the discharge passage.

9. The storehouse of claim 8, wherein the discharge passage is located closer to a center of the fan assembly than a center of the first heat exchanger.

10. The storehouse of claim 1, wherein at least one of the first heater or the second heater is coupled to a fin of the first heat exchanger.

11. The storehouse of claim 1, wherein the first portion defines a top first end of the first heat exchanger, and the second portion defines a bottom of the first heat exchanger.

12. The storehouse of claim 10, further comprising a fan heater provided at the fan assembly, and a controller configured to control at least one of the first heater or the second heater and the fan heater so that the fan heater is driven after driving of at least one of the first heater or the second heater is completed.

13. The storehouse of claim 1, further comprising a planar heater provided on the inner surface of the heat exchanger case, wherein the planar heater is disposed between the second heater and the inner surface of the heat exchanger case.

14. The storehouse of claim 13, wherein the heat exchanger case includes a drain hole through which fluid flows out of the second space, and wherein the planar heater is positioned above the drain hole.

15. The storehouse of claim 14, wherein the inner surface of the heat exchanger case is sloped downward toward the drain hole.

* * * * *